US011634976B2

(12) United States Patent
Wetzel

(10) Patent No.: US 11,634,976 B2
(45) Date of Patent: Apr. 25, 2023

(54) ELECTRIC SUBMERSIBLE PUMP (ESP) RIG LESS DEPLOYMENT METHOD AND SYSTEM FOR OIL WELLS AND THE LIKE

(71) Applicant: James R Wetzel, Richmond, TX (US)

(72) Inventor: James R Wetzel, Richmond, TX (US)

( * ) Notice: Subject to any disclaimer, the term of this patent is extended or adjusted under 35 U.S.C. 154(b) by 0 days.

(21) Appl. No.: 17/499,939

(22) Filed: Oct. 13, 2021

(65) Prior Publication Data

US 2022/0178232 A1 Jun. 9, 2022

Related U.S. Application Data

(60) Provisional application No. 63/122,033, filed on Dec. 7, 2020.

(51) Int. Cl.
*E21B 43/12* (2006.01)
*E21B 17/02* (2006.01)

(52) U.S. Cl.
CPC ..... *E21B 43/128* (2013.01); *E21B 17/028* (2013.01)

(58) Field of Classification Search
CPC ..... E21B 43/128; E21B 17/028; E21B 17/023
See application file for complete search history.

(56) References Cited

U.S. PATENT DOCUMENTS 7,533,461 B2 5/2009 Griffiths
7,640,993 B2 * 1/2010 Head ..... E21B 17/026 166/385
8,485,837 B2 7/2013 Head
8,746,354 B2 6/2014 Head
8,816,196 B2 8/2014 Williams et al.
8,950,476 B2 2/2015 Head
9,028,264 B2 * 5/2015 Head ..... H01R 13/523 439/190
9,197,006 B2 11/2015 Hack
9,270,051 B1 2/2016 Christiansen et al.
9,322,252 B2 4/2016 Head
9,419,362 B2 8/2016 Lin
9,556,686 B1 1/2017 Krumpe
9,647,381 B2 5/2017 Head
9,825,400 B2 * 11/2017 Clingman ..... H01R 13/6215
9,941,622 B1 4/2018 Campbell
10,267,097 B2 4/2019 Mendez et al.
10,276,969 B2 4/2019 Campbell
10,533,381 B2 1/2020 Head et al.
(Continued)

*Primary Examiner* — Christopher J Sebesta
(74) *Attorney, Agent, or Firm* — Ritchison Law Offices, PC; John D. Ritchison

(57) ABSTRACT

A deployment system as a rig less docking station with an inline male wet mate-able connectors and power cable and a motor connector with inline female wet mate-able connectors coupled to an electric submersible pump (ESP), the docking station is at the bottom of a string of production tubing and remains in the well for the life of the system while the motor connector is mated to an ESP and lowered into the well by wireline or other suitable deployment method. The rig less deployment system has a lower initial cost, larger through-bore, improved debris tolerance, and the ability for pump-assisted installation and retrieval techniques. Both the moveable female and the static male connector are pressure balanced for temperature and volume variation and the male connector utilizes a heavy dielectric fluid in a reverse labyrinth design to isolate borehole fluid from the electrical connection.

17 Claims, 13 Drawing Sheets

Figures 1A, 1B:
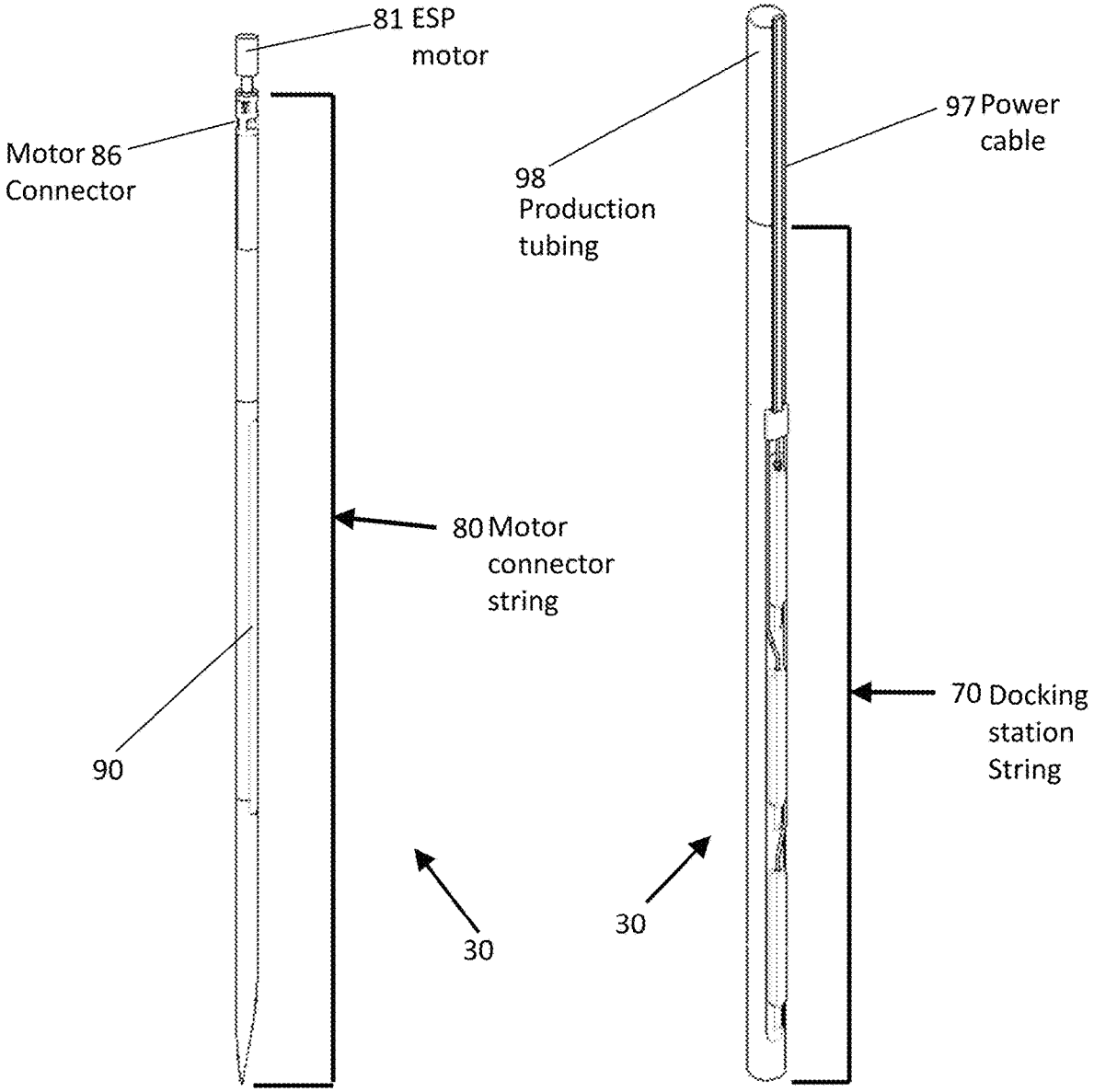

Wet mate connector positions on docking station connector

(56) References Cited

U.S. PATENT DOCUMENTS

| | | | | |
|---|---|---|---|---|
| 10,605,056 | B2 | 3/2020 | Hartley | |
| 10,693,251 | B2 | 6/2020 | Ross et al. | |
| 11,021,939 | B2 | 6/2021 | Crowley et al. | |
| 2002/0050361 | A1* | 5/2002 | Shaw | E21B 43/128 166/380 |
| 2014/0030904 | A1* | 1/2014 | Head | H01R 13/523 439/283 |
| 2021/0140247 | A1 | 5/2021 | Bishop et al. | |

* cited by examiner

ESP/motor connector string 80

Docking station on production tubing string 70

Wet mate connector positions on motor connector

Wet mate connector positions on docking station connector

ESP/Motor connector alignment features

Vertical Alignment tab

Flow tube

Discharge head
and landing shoulder on motor connector

Wet mate female connector

Discharge head and wet mate connector

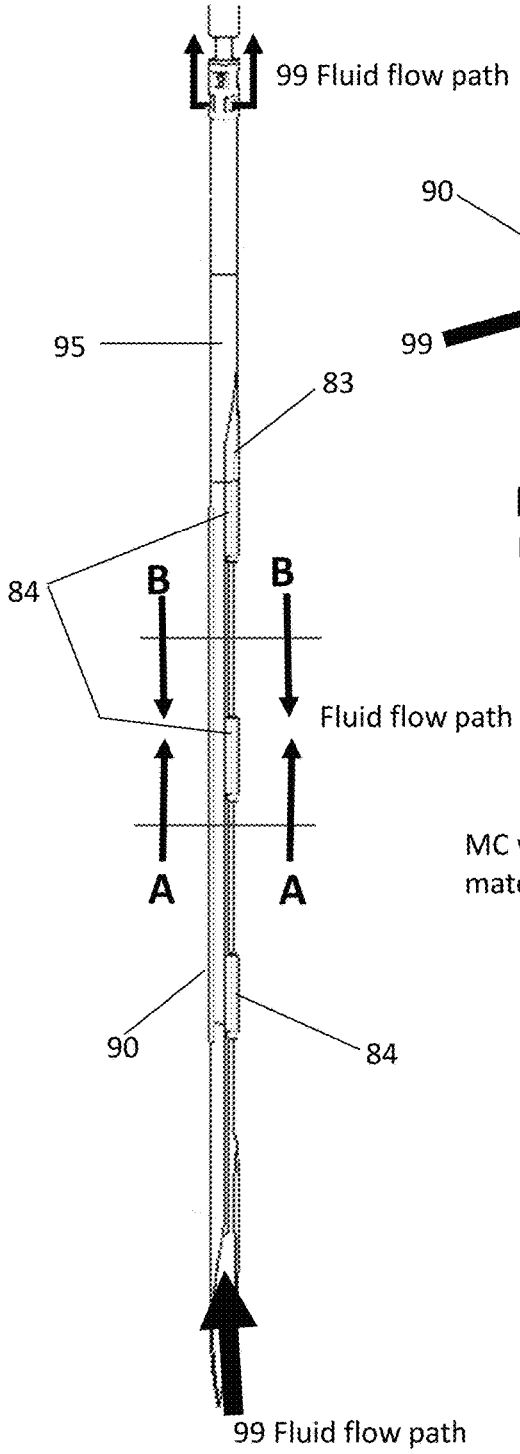
Fig. 5 A
Fluid flow path through motor connector
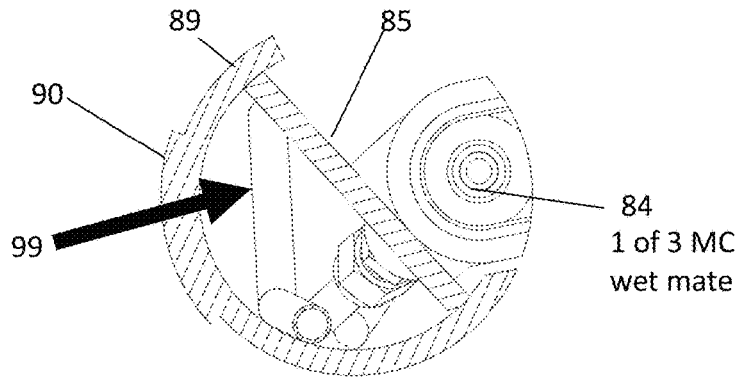
Fig. 5 B Section A-A
Bottom view fluid flow path
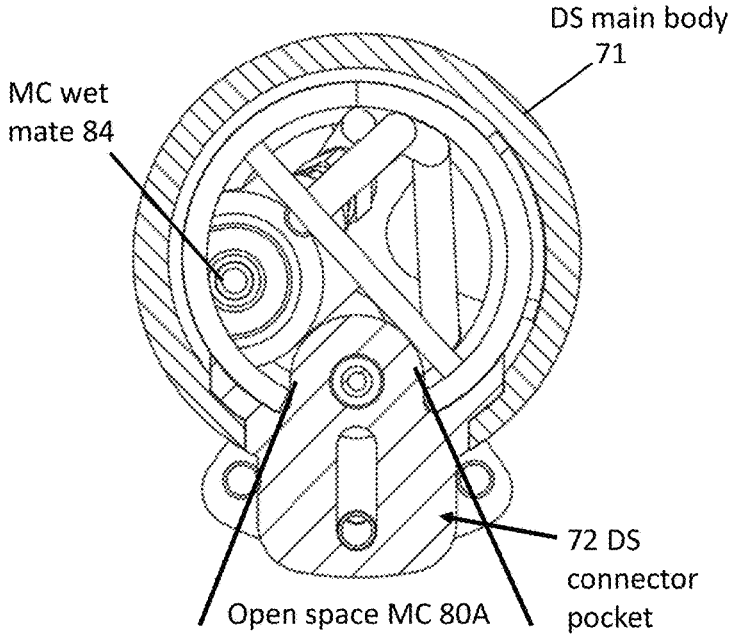
Fig. 5 C Section B-B
Top view fluid flow path Top View Docking Station alignment Features & landing shoulder Alignment guide 78 features Wet mate connector
position in main body Motor connector rotation
Spear function Motor connector rotated to
begin straight drop Motor connector tab
Drops straight in docking
station groove
Aligning tab on motor connector
follows the guide path groove in
the docking station to maintain
straight drop Alignment tab in docking station contacts the final alignment groove in the motor connector alignment guide Motor connector is rotated to final position to begin final drop and mate Wet mate male and female alignment prior to mating Bottom view of female wet mate connector Landing shoulder on motor connector approaching landing shoulder in docking station Final mate of wet mate connectors with shuttle body moving down to allow shuttle pin to insert in female connector US Patent 9,028,264
Downhole Electrical Connector
2015 - Head US Patent 8,746,354
Wet Connection System
For Downhole Equipment
2014 - Head US Patent 10,276,969
Connector w/ Sealing Boot
& Moveable Shuttle
2019 - Campbell US Patent 7,533,461
Method for Interconnecting Conduits
In a Borehole
20009 - Griffiths

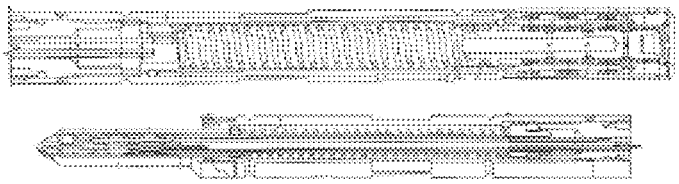
204
Fig. 12 E
Prior Art
US Patent 9,270,051
Wetmate Connector
2016 – Christianson et al
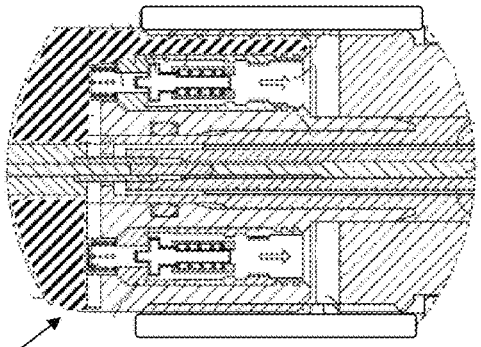
206
Fig. 12 G
Prior Art
US Patent 9,556,686
Wet-Mateable Connector Unit
w/Gas Pressure Relief
2017 - Krumpe
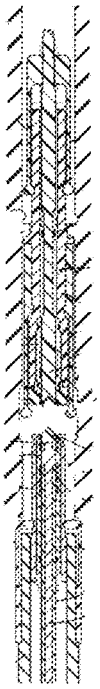
207
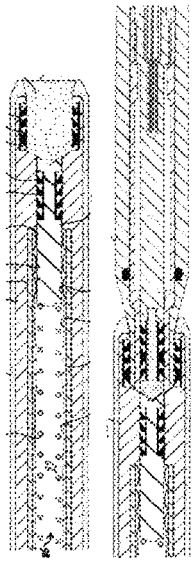
205
Fig. 12 F
Prior Art
US Patent 9,546,527
Wet Connection System
For Downhole Equipment
2017 - Head
Fig. 12 H
Prior Art
US Patent 8,485,837
Electrical Wet Connector
In Downhole Environment
2013 - Head
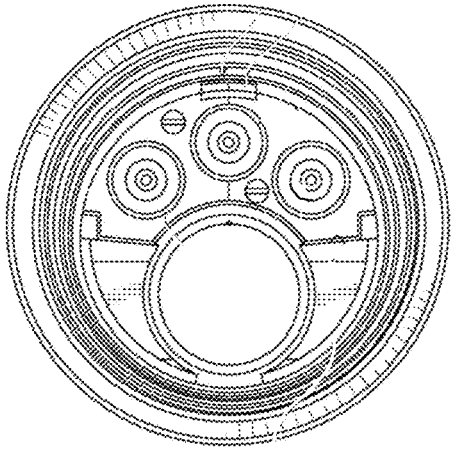
208
Fig. 12 I
Prior Art
US Patent 11,021,939
System and method related
to pumping fluid in a borehole
2021 - Crowley, et al.

ELECTRIC SUBMERSIBLE PUMP (ESP) RIG LESS DEPLOYMENT METHOD AND SYSTEM FOR OIL WELLS AND THE LIKE

CROSS-REFERENCE TO RELATED APPLICATIONS

This application claims the benefit of U.S. Provisional Patent Application with Ser. No. 63/122,033 filed Dec. 12, 2020, by James R. Wetzel. The application is entitled "Electrical Submersible Pump (ESP) Rig Less Deployment Method and System for Oil Wells and the like".

FIELD OF INVENTION

This invention relates to a method and system for making an electrical connection in an underground borehole that provides for the transmission of electric power from a power supply to the motor of an electric submersible pump (ESP). This invention relates to wet connectors for downhole use, which is to say, releasable connectors for electrical conductors which can be made and unmade in the fluid environment of a wellbore, particularly but not exclusively a hydrocarbon well. The field of the invention relates generally to wet mate connectors installed in downhole environments, and more particularly to a receptacle connector effectively engaged with a mating plug connector.

This invention relates to wet connection systems for connecting a conductor or conductors to equipment deployed in a borehole, for example, an oil or gas well. Wet connection systems provide a connection that can be made and unmade in-situ in a liquid environment so that the deployed equipment can be disconnected and recovered without removing the conductor from the borehole, and then re-connected to the conductor in situ when the equipment is re-deployed. This invention relates to electrical connections for conductors in a downhole environment, particular connections that are engageable and releasable downhole.

FEDERALLY SPONSORED RESEARCH

None.

SEQUENCE LISTING OR PROGRAM

None.

BACKGROUND

Field of Invention and Prior Art

As far as known, there are no Electric Submersible Pump (ESP) Rig Less Deployment Method and System for Oil Wells and the like. It is believed that this product is unique in its design and technologies. The production of fluid from an oil or gas well is often performed using an Electric Submersible Pump (ESP). The pump is typically installed in a borehole by mating to the bottom of a production tubing string and lowered into the borehole. The power cable is banded to the outside of the production tubing. When there is a failure of the ESP a workover rig is required to pull the tubing and pump from the well for replacement. The high cost associated with these workovers has generated interest in finding an alternative method to deploy the ESP. Several different methods have been developed to date and the most promising method utilizes a system that leaves the electrical connection in the well and can install the ESP on wireline, coiled tubing, or sucker rods.

BACKGROUND

This background as to Electric Submersible Pumps and their connection to electrical power will be useful to help one to fully understand the importance of this invention. An oil or gas well may use many types of apparatus that require an electric connection, such as tools and measuring devices that are lowered down the well, and equipment that is installed or present in a casing or production tube. Electrical power for these tools is usually supplied through a conductive line from the surface extending from the tool to the surface. Usually, an oil or gas well will be lined with tubing that is cemented into the borehole to form a permanent well casing, the inner surface of the tubing defining the wellbore. (In this specification, a "tube" or "tubing" means an elongate, hollow element which is usually but not necessarily of circular cross-section, and the term "tubular" is to be construed accordingly.) The fluid produced from the well is ducted to the surface via production tubing which is usually deployed down the wellbore in jointed sections and (since its deployment is time consuming and expensive) is preferably left in situ for the productive life of the well. Where an ESP is used to pump the well fluid to the surface, it may be permanently mounted at the lower end of the production tubing but is more preferably deployed by lowering it down inside the production tubing on a wireline or on continuous coiled tubing (CT), so that it can be recovered without disturbing the production tubing.

In some cases, an electric submersible pump (ESP) is installed in wells to increase the production of hydrocarbon fluid from a well. In general, an ESP is an "artificial lift" mechanism that is typically positioned relatively deep within the well where it is used to pump the hydrocarbon fluid to the surface. However, installation of an ESP on an existing well can be very expensive for several reasons. First, installation of an ESP on an existing well requires that the completion be pulled and replaced with a completion that is designed for and includes the ESP. Second, such workover operations require the use of expensive vessels (e.g., ships or rigs) to re-complete the well, given the equipment that must be removed from the well during these workover operations. Even in the case where the well initially included an ESP, or where one was later added to the well, such ESPs do malfunction and need to be replaced. Thus, even in this latter situation, expensive vessels must be employed in replacing previously installed ESPs.

Sometimes a conductive line must be disposed down the well to attach to the tool, rather than the tool being lowered with the conductive line already attached. There are many reasons why the conductive line is not always installed simultaneously with the tool; the tool may have been installed with or incorporated in the casing or production tube, or it may be convenient to install a particular tool down a casing or production line without an electric line, or an already attached electric line may have to be recovered due to a fault or to allow another tool access. To make an electric connection in this downhole environment, it must be ensured firstly that the lowered connector locates and engages securely with the installed connector, and further that well fluid and material suspended in the well fluid does not penetrate between the surfaces of the connectors to prevent or degrade the conduction between the connection. Ideally, the connection should be reversible without damaging the connectors, allowing the lowered connection to be released and removed from the well, and re-lowered and re-attached as many times as necessary.

In oil and gas well connector applications, the plug and receptacle units of wet-mate able downhole electrical connectors are mated and de-mated at a point downhole or subsea to releasably connect power or signal to downhole equipment such as pumps, sensors, or the like, with the connector units oriented vertically or at an angle. One of the connector units is connected to the downhole equipment while the other connector unit is at the end of a power supply or signal communication cable A wet connector typically comprises a male part comprising one or a group of plugs, and a female part comprising a corresponding number of sockets, or each respective plug and socket having a single electrical contact or an array of contacts. Either the male or the female part may be arranged on the tool, with the other part being arranged on the power or signal line. For ESPs and other electrical tools running on a three-phase power supply, the connector may comprise for example a single plug and socket having three axially spaced contacts, or a group of three plugs and sockets, each having a single electrical contact. To exclude wellbore fluids from the connector, it is usual to occlude the bore of the socket with a retractable insert which is displaced by the plug. The sliding interface between the socket and the insert is protected by one or a series of annular seals known as wiper seals, hereinafter also referred to as wipers, which slidingly wipe contaminants from the surface of the plug as it enters the socket. In practice it is found that as the plug enters the socket, contaminants clinging to the plug may travel past the or each wiper to form an electrically conductive path, leading to failure of the connector.

Problem Solved

The purpose of this invention is to lower the initial cost for the operator and provide a simpler system that is more reliable. In addition, the invention will offer a larger through bore and will provide the ability for pump assisted installation and retrieval techniques that could be developed in the future. The improvement and problems solved as to Electric Submersible Pump (ESP) Rig Less Deployment Method and System for Oil Wells and the like include: a small diameter motor connector and low-profile docking station that allows for installation of standard 456 ESP motors in a typical seven inch (7") tubing; a large through bore; improved debris tolerance; an installation that requires no protective sleeve for intervention; an installation that is capable of reverse circulation for pump assist retrieval and installation; one that can have a more than three (3) connectors to power multiple down hole components and systems; and an installation that requires no special kick out tool for installation.

Prior Art

It is believed that this product is unique in its design and technologies. A novelty search revealed:

A U.S. Pat. No. 7,533,461 entitled a Method for interconnecting electrical conduits in a borehole was issued to Griffiths in 2009.

B U.S. Pat. No. 9,028,264 is named a Downhole electrical wet connector and was issued to Head in 2015.

C U.S. Pat. No. 8,816,196 called Pressure balanced connector termination was issued to Williams, et al. in 2014.

D U.S. Pat. No. 9,197,006 titled Electrical connector having male and female contacts in contact with a fluid in fully mated condition was issued to Hack in 2015.

E U.S. Pat. No. 9,270,051 named a Wet mate connector was issued to Christiansen, et al. in 2016.

F U.S. Pat. No. 9,419,362 is called Electrical receptacle connector issued to Lin in 2016.

G U.S. Pat. No. 9,556,686 named Wet-mateable connector unit with gas pressure relief was issued to Krumpe in 2017.

H U.S. Pat. No. 9,941,622 named Connector with sealing boot and moveable shuttle was issued to Campbell in 2018.

I U.S. Pat. No. 10,267,097 called a Pressure compensating connector system, downhole assembly, and method was issued to Mendez, et al. in 2019.

J U.S. Pat. No. 10,276,969 named a Connector with sealing boot and moveable shuttle was issued to Campbell in 2019.

K U.S. Pat. No. 10,605,056 titled System for installing an electrically submersible pump on a well was issued to Hartley in 2020.

L U.S. Pat. No. 10,693,251 was named an Annular wet connector and issued to Ross, et al. in 2020.

M U.S. Pat. No. 8,485,837 called an Electrical wet connector in downhole environment was issued to Head in 2013.

N U.S. Pat. No. 8,746,354 is titled a Wet connection system for downhole equipment and issued to Head in 2014.

O U.S. Pat. No. 8,950,476 is called a Coiled tubing deployed ESP and was issued to Head in 2015.

P U.S. Pat. No. 9,322,252 named as a Fixed wet connection system for an electric submersible pump issued to Head in 2016.

Q U.S. Pat. No. 9,546,527 called a Wet connection system for downhole equipment again was issued to Head in 2017.

R U.S. Pat. No. 9,647,381 named Downhole electrical wet connector issued to Head in 2017.

S U.S. Pat. No. 10,533,381 is titled a Wet connection system for downhole equipment. Again, issued to Head, et al. in 2020.

T is a world patent WO0102699 called a METHOD OF DEPLOYING AN ELECTRICALLY DRIVEN FLUID TRANSDUCER SYSTEM IN A WELL. It issued to Smith in 2001.

U US Publication 20210140247 was named an ESP TUBING WET CONNECT TOOL and published for Bishop et al.

V U.S. Pat. No. 11,021,939 named a System and method related to pumping fluid in a borehole which was issued to Crowley, et al. in June, 2021. It shows and demonstrates a technique facilitates use of a submersible pumping system deployed downhole in a borehole. This docking assembly comprises a docking station which has at least one electrical wet connector and is coupled to a receiving tubular. An electrical power cable is coupled to the docking station to enable electrical power to be provided to the at least one electrical wet connector. The docking assembly is deployed downhole to a desired location in the borehole to enable coupling with the submersible pumping system. The submersible pumping system is simply moved downhole into the receiving tubular and into electrical engagement with the electrical wet connectors.

As can be observed, none of the prior art has anticipated or caused one skilled in the art of wetmate connection systems and methods for ESPs or the like to see this invention by Wetzel as obvious to a person skilled in the ordinary art of the industry. The Electric Submersible Pump (ESP) Rig Less Deployment Method and System for Oil Wells and the like solves many problems and is a unique system to address the needs for the oil well industry by providing a simple deployment and connection system which needs no special rigs or equipment to maintain the electric submersible pumps. More description as to the unique characteristics associated with this application are explained below. For example, specific as to comparing the most recent U.S. Pat. No. 11,021,939, this application by Wetzel differs from Crowley, et al. in the orientation of the wet mate connectors and many other specific and novel features. See FIG. 12 detailed description, below. Advantages of Wetzel over Crowley, et al. include: a larger through bore, a smaller outside diameter (OD) of the motor connector that allows for a smaller ID of the production tubing which facilitates the ability to install a "456" ESP inside a standard seven-inch (7") casing; and a vertical alignment orientation that allows for the addition of wet mate connectors to drive other electrical components that may be incorporated in the well completion. In addition, typical ESP well completions include a subsurface safety valve to provide emergency closure of producing conduits in the event of an emergency. The large diameter motor connector of the Crowley patent typically requires the use of a sub-surface safety valve below the ESP. Sub surface safety valves set deep into a well are extremely expensive and a failed sub-surface safety valve may require a heavy workover to remove the completion for repair. The Wetzel patent with the smaller diameter motor connector allows for the use of a sub-surface safety valve at a few hundred feet below the well head. These sub-surface safety valves may also be wireline retrievable for easy repair or replacement. A significant cost saving for the well operator.

SUMMARY OF THE INVENTION

This invention is an Electric Submersible Pump (ESP) Rig Less Deployment Method and System for Oil Wells and the like. In accordance with some embodiments of the invention there is provided a method to interconnect electrical conductors in an underground borehole by means of a static male connector and a moveable female connector. The mating operation consists of aligning the center of the moveable connector contact with the conductor pin of the static connector then the moveable connector presses on the shuttle body of the static connector causing the outer body of the static connector to move axially along a guide tube containing the conductor. Concurrently, the conductor pin is pushed into the moveable connector and is mated to the electrical contact in the moveable connector. The travelling pin of the moveable connector is pushed out of the top of the moveable connector by the motion of the conductor pin.

The rig less deployment system has a docking station with male wet mate able connectors and power cable and a motor connector with female wet mate able connectors that will be mated to an electric submersible pump (ESP). The docking station will be hung at the bottom of a string of production tubing. The docking station will remain in the well for the life of the system. The motor connector will be mated to the bottom of an ESP and lowered into the well by wireline, coiled tubing, sucker rods or other suitable deployment method.

The preferred embodiment of an Electric Submersible Pump (ESP) Rig Less Deployment System for an Oil Well production downhole installation made of durable materials and comprised of a docking station that is semi-permanently and removably installed into a borehole of an oil well; a motor connector that may be removed from the borehole; an inline electrical connection between the motor connector and docking station comprising a power cable and each of three separate connectors to provide electrical power to a three-phase motor of an electric submersible pump (ESP); an option of an additional set of connectors can be incorporated in the system to facilitate electrical connections for other components; the docking station further comprises a main body, three electrical male connectors, and an alignment guide tube with orientation features and with a landing shoulder; and the motor connector further comprises three electrical female connectors, a partition mounting plate, and an alignment guide section with orientation features whereas the Electric Submersible Pump (ESP) Rig Less Deployment System for an oil well production installation lowers the initial cost for the operator, provides a simpler system that is more reliable, offers a larger through bore, and provides the ability for pump assisted installation and retrieval techniques for future developments.

The newly invented Electric Submersible Pump (ESP) Rig Less Deployment System for Oil Wells and the like for various applications may be manufactured at low volumes by very simple means and in high volume production by more complex and controlled systems.

Objects and Advantages

There are several objects and advantages of the Electric Submersible Pump (ESP) Rig Less Deployment Method and System for Oil Wells and the like. There are currently no known ESP deployment systems and/or devices in the prior art that are effective at providing the objects of this invention. The various advantages and benefits:

| Item | Advantages |
|---|---|
| 1 | Large through bore |
| 2 | Improved debris tolerance |
| 3 | No protective sleeve required for intervention |
| 4 | Capable of reverse circulation for pump assist retrieval and installation |
| 5 | Can have a more than 3 connectors to power multiple down hole components and systems |
| 6 | No special kick out tool required for installation |
| 7 | Small diameter motor connector and low-profile docking station allows for installation of standard 456 ESP motors in 7" tubing. |
| 8 | the smaller OD motor connector allowing for a shallow set sub-surface safety valve.** |

**One skilled in the art of these type of installations appreciates that sub-surface safety valves are installed in ESP wells to provide the ability to shut in the well in the event of an emergency. They use a spring force to act against the well bore pressure to facilitate the closing operation. When the sub-surface safety valve is set deep in a well the well pressure is higher and the valve is very expensive. The cost is often four to five (4 to 5) times the cost of a shallow set valve. In addition, if the valve fails the completion may have to be pulled to repair. The Wetzel configuration allows the use of shallow set wireline retrievable safety valves that are lower cost and easier to repair.

Finally, other advantages and additional features of the present Electric Submersible Pump (ESP) Rig Less Deployment Method and System for Oil Wells and the like will be more apparent from the accompanying drawings and from the full description of the device. For one skilled in the art of oil well pumping and retrieval devices and systems, it is readily understood that the features shown in the examples with this product are readily adapted to other types of oil and gas well retrieval systems and devices.

DESCRIPTION OF THE DRAWINGS—FIGURES

The accompanying drawings, which are incorporated in and constitute a part of this specification, illustrate an embodiment of the Electric Submersible Pump (ESP) Rig Less Deployment Method and System for Oil Wells and the like that is preferred. The drawings together with the summary description given above and a detailed description given below explain the principles of the Rig less deployment method and system. It is understood, however, that the method and system herein described is not limited to only the precise arrangements and instrumentalities shown.

FIG. 1 A is a sketch of an ESP/motor connector string and FIG. 1 B is a sketch of a docking station on production tubing string.

Figure 2A:
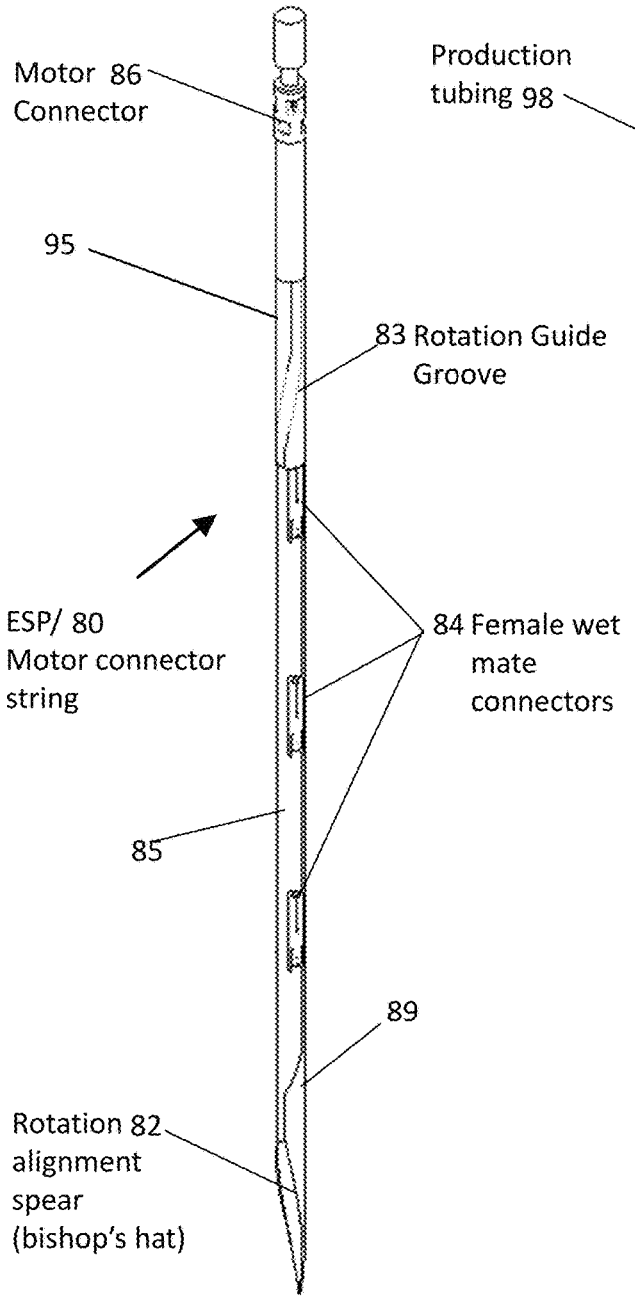
Figure 2B:
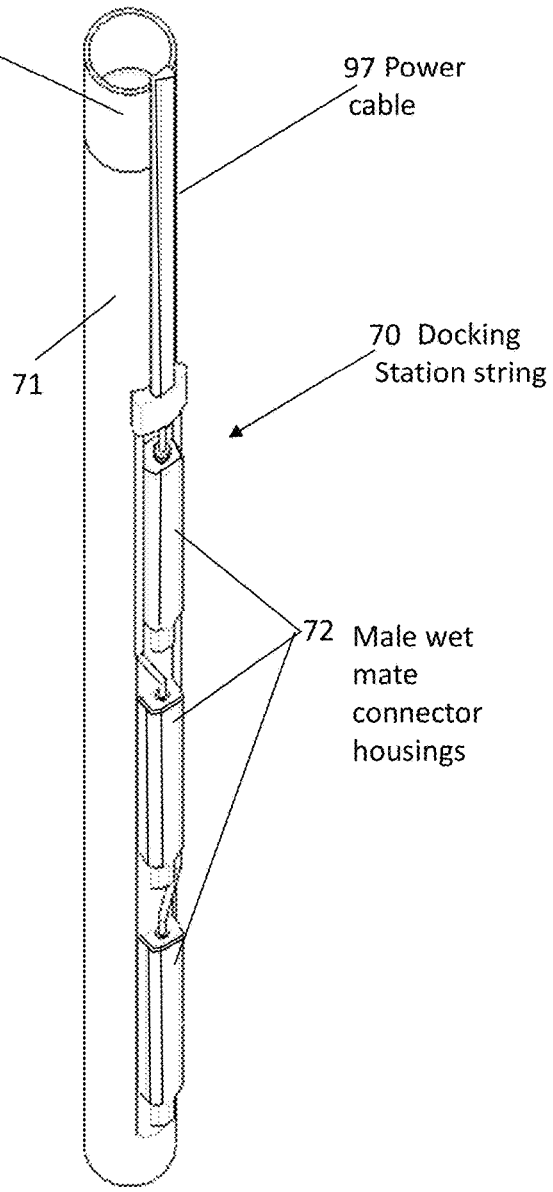

FIG. 2 A is a sketch of a wet mate connector positions on motor connector and FIG. 2 B is a sketch of a wet mate connector positions on docking station connector.

Figures 3A, 3B, 3C:
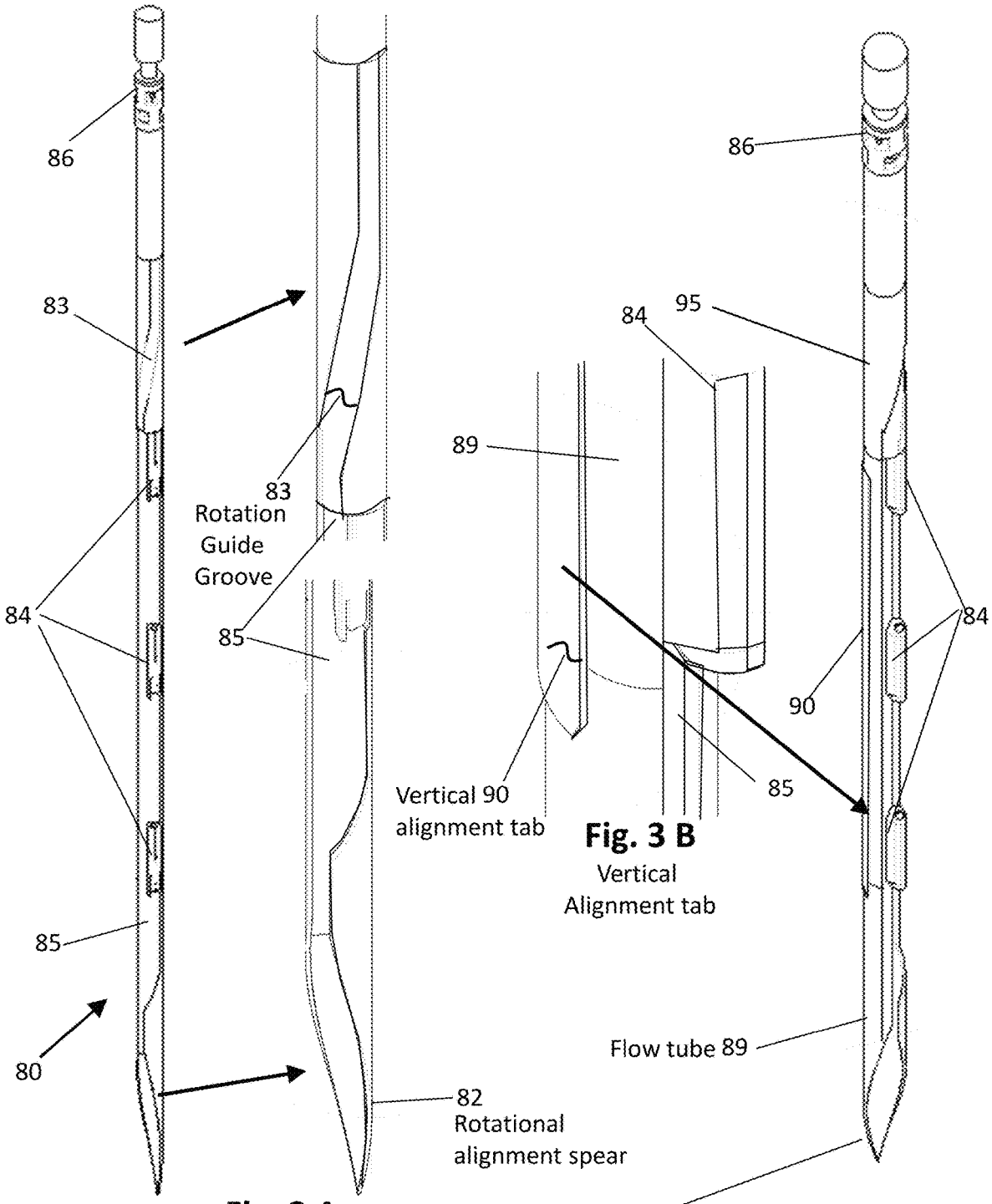

FIG. 3 A is a sketch of an ESP/Motor connector alignment features, FIG. 3 B is a sketch of a vertical alignment tab, and FIG. 3 C is a sketch ninety degrees from FIG. 3 A to show the position of the alignment tab on the outside of the flow tube.

Figures 4A, 4B, 4C:
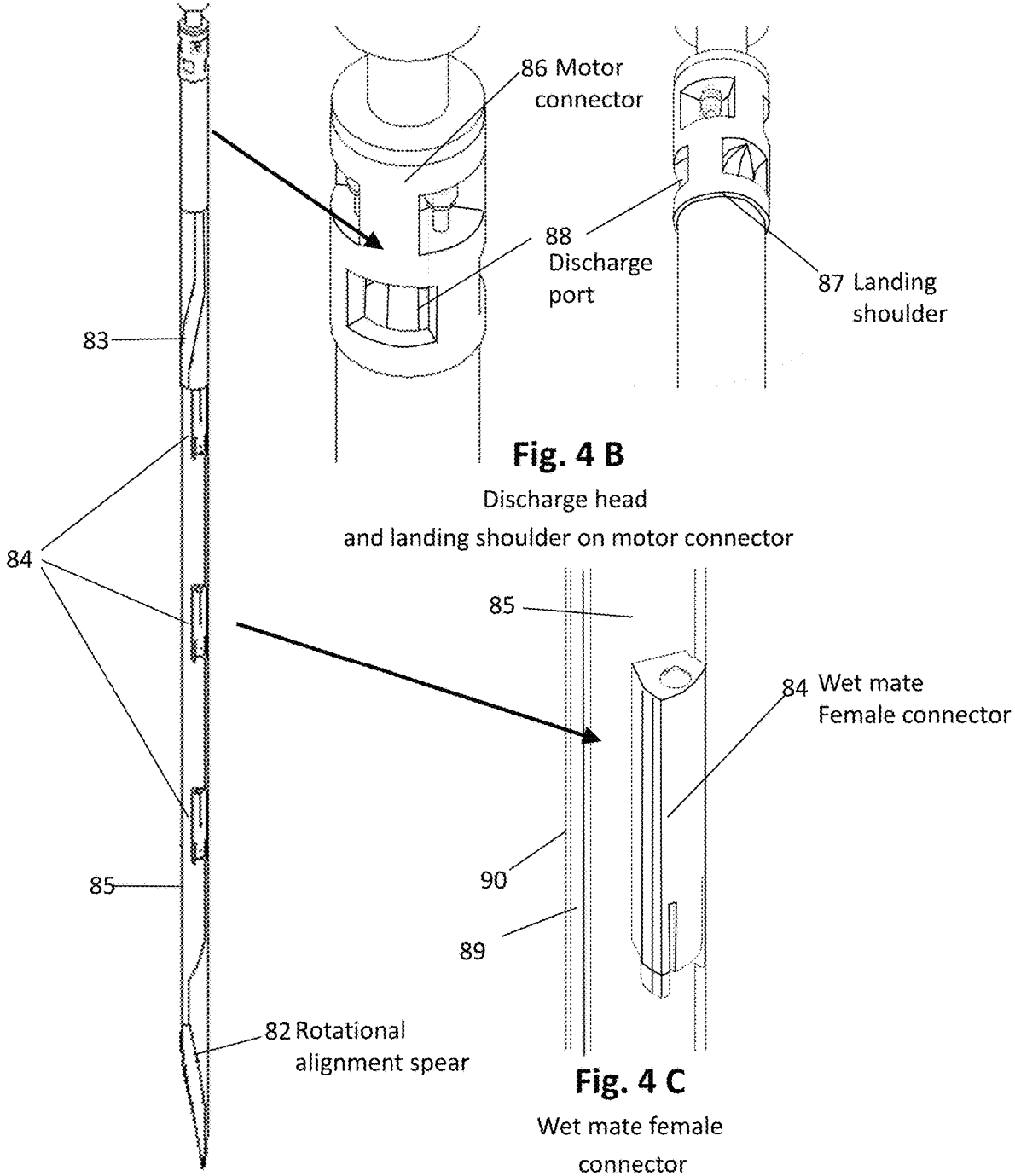

FIG. 4 A is a sketch of the position of a discharge head and the wet mate connector on the motor connector, FIG. 4 B is a sketch of a discharge head and landing shoulder on motor connector, and FIG. 4 C is a sketch of a wet mate female connector.

FIG. 5 A is a sketch of a fluid flow path through motor connector, FIG. 5 B is a sketch of the Section A-A bottom view fluid flow path, and FIG. 5 C is a sketch of Section B-B showing a top view of the fluid flow path.

Figures 6A, 6B, 6C:
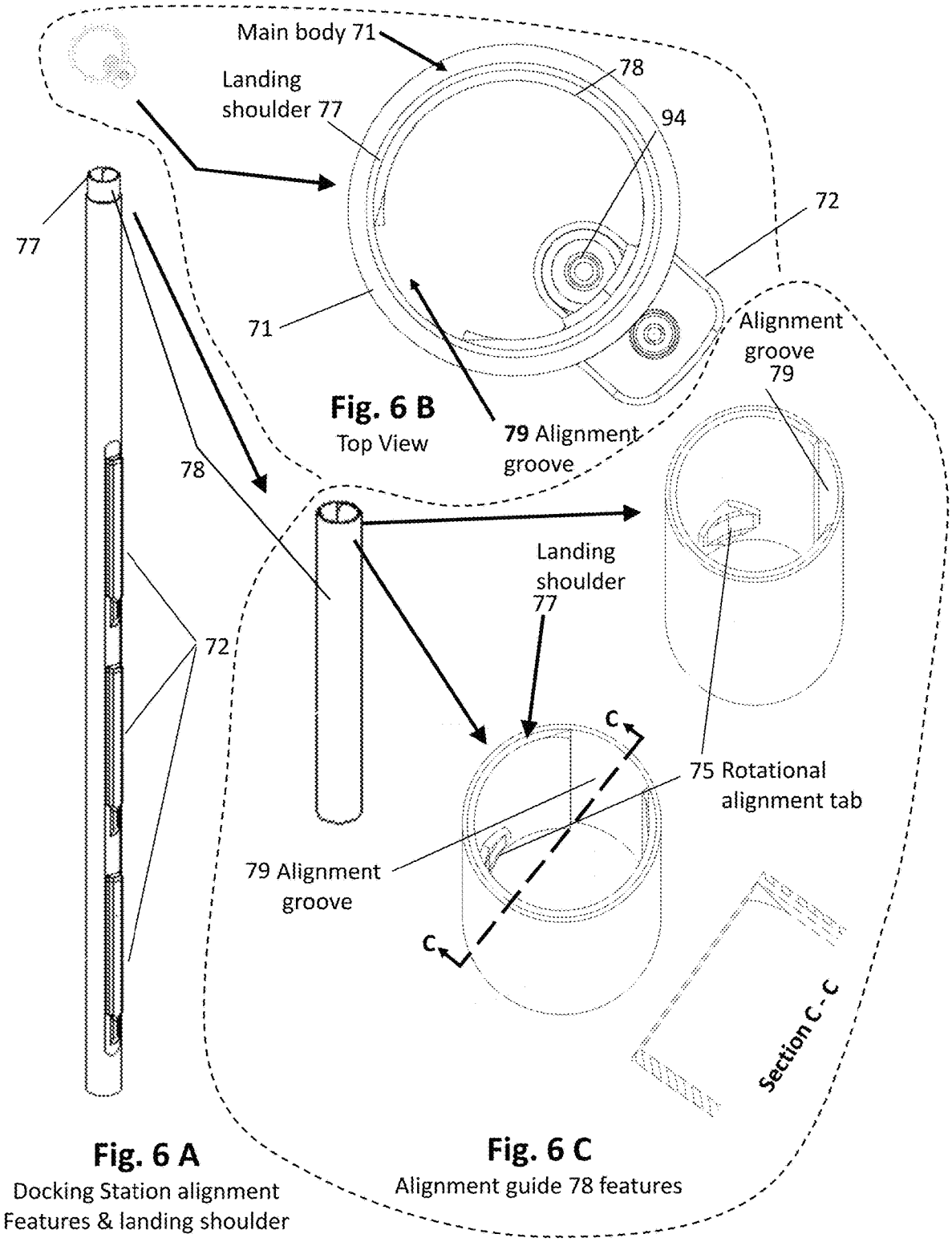

FIG. 6 A is a sketch of the alignment guide of a docking station with the alignment features and landing shoulder, FIG. 6 B is a sketch of a top view, and FIG. 6 C is a sketch of an alignment guide features.

Figure 7:
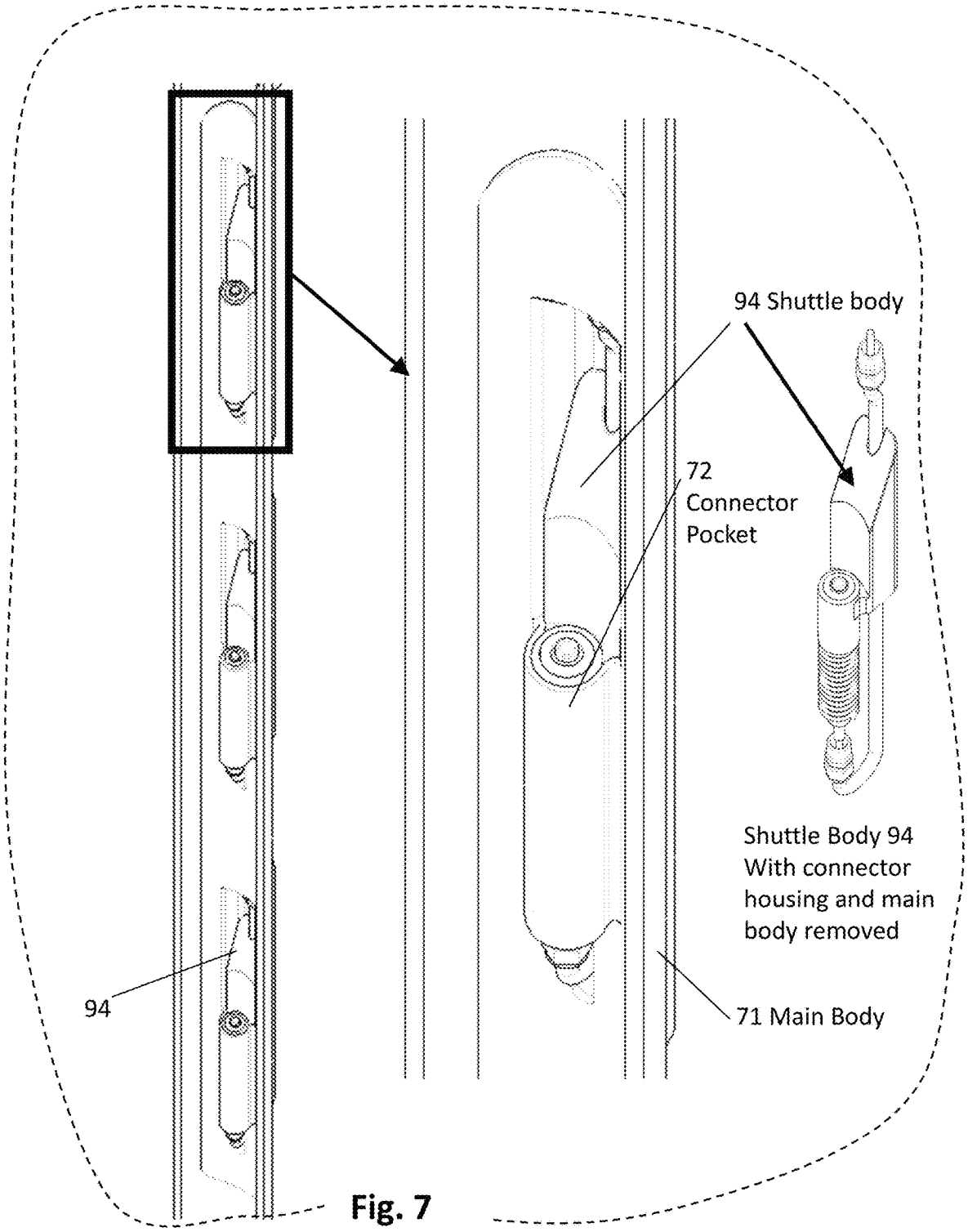

FIG. 7 is a sketch of a wet mate connector position in the main body.

Figures 8A, 8B, 8C:
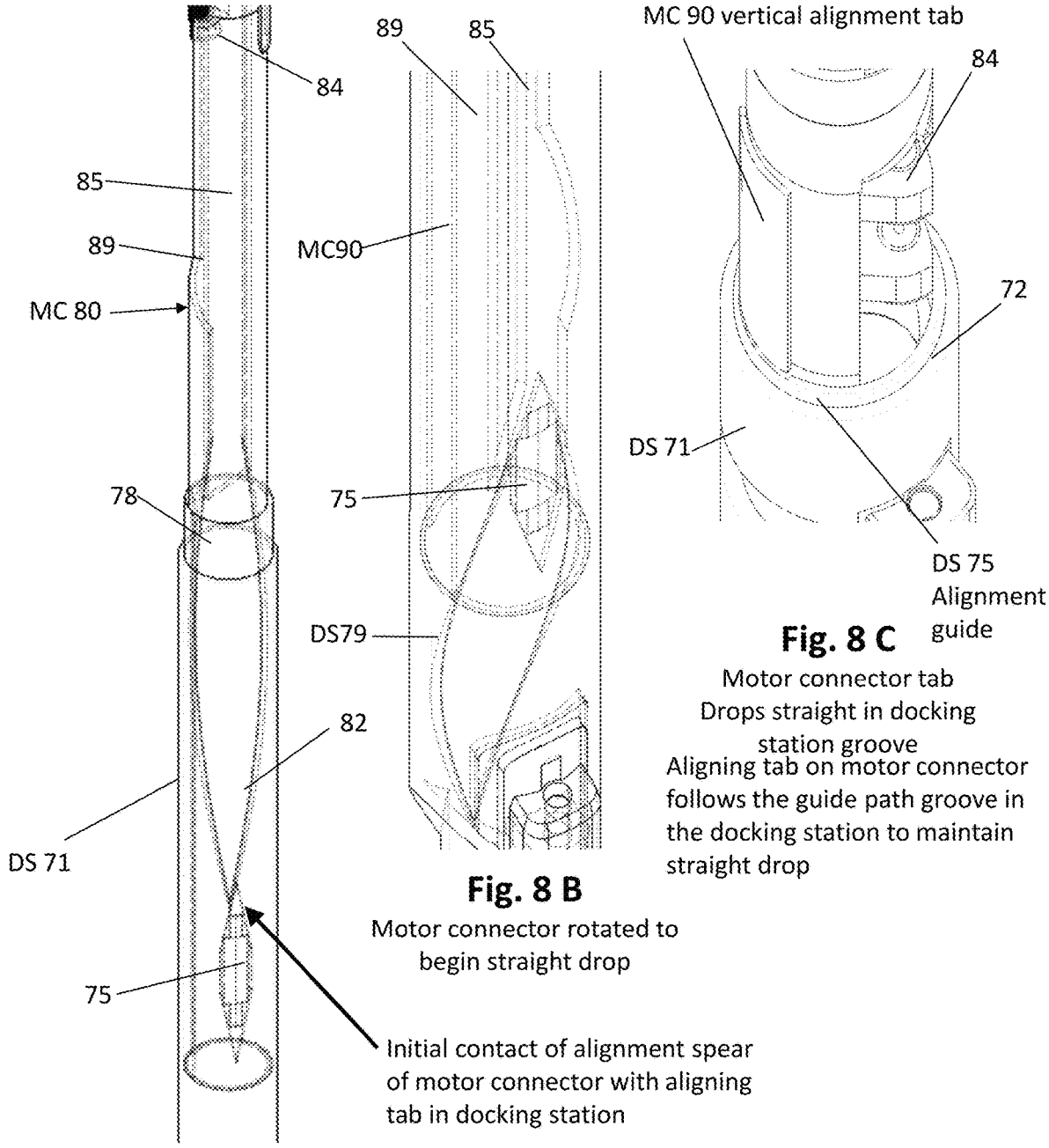

FIG. 8 A is a sketch of a motor connector rotation spear function, FIG. 8 B is a sketch of a motor connector rotated to begin straight drop, and FIG. 8 C is a sketch of a motor connector alignment tab as it enters the alignment groove and drops straight into the docking station.

Figure 9A:
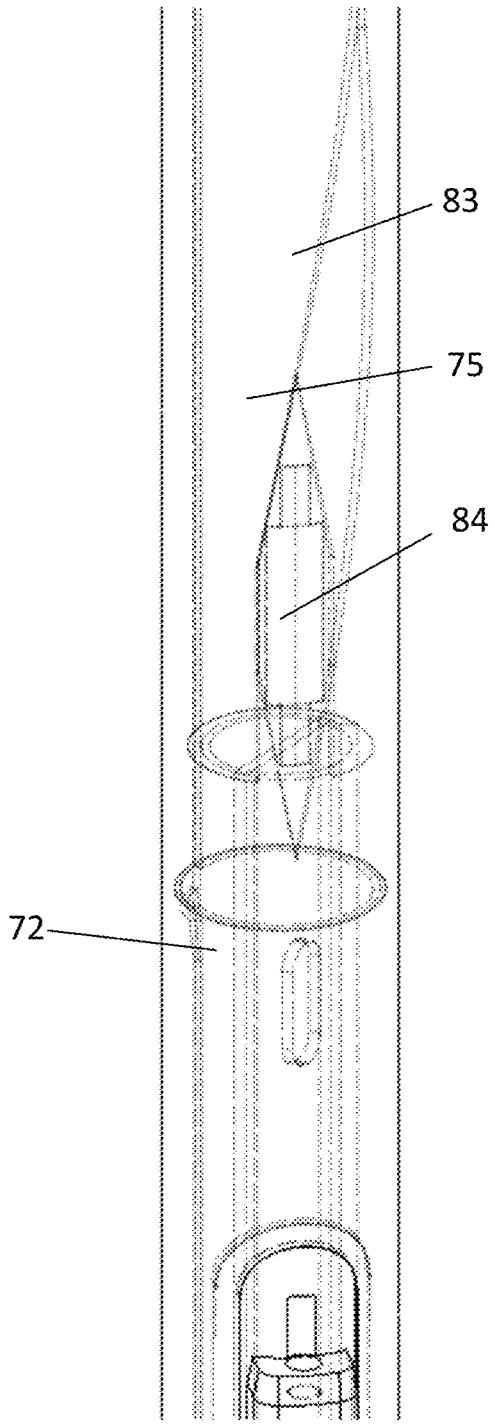
Figure 9B:
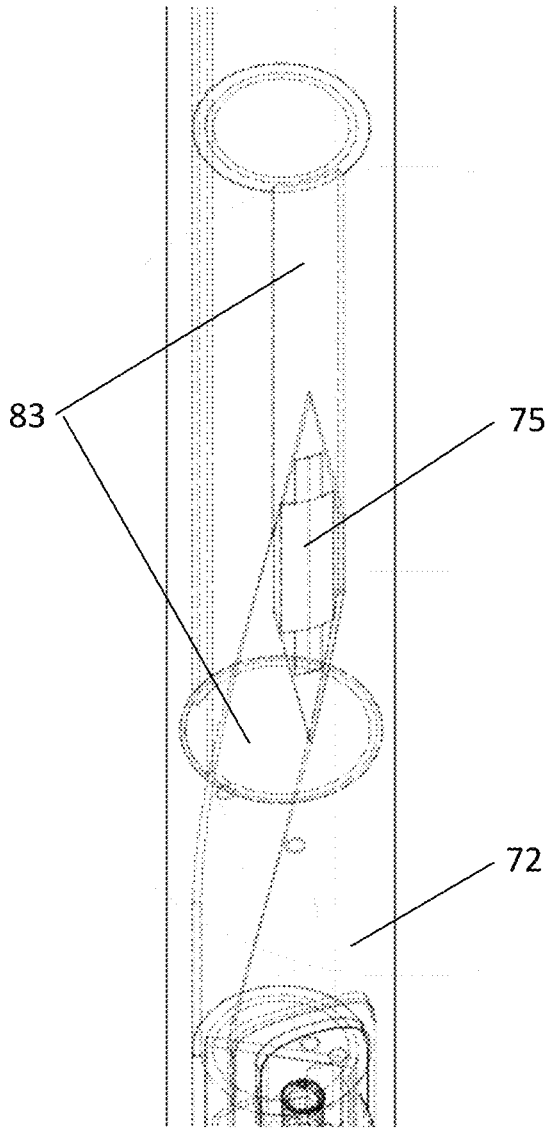

FIG. 9 A is a sketch of an alignment tab in docking station contacts the final alignment groove in the motor connector alignment guide and FIG. 9 B is a sketch of a motor connector is rotated to final position to begin final drop and mate.

Figure 10A:
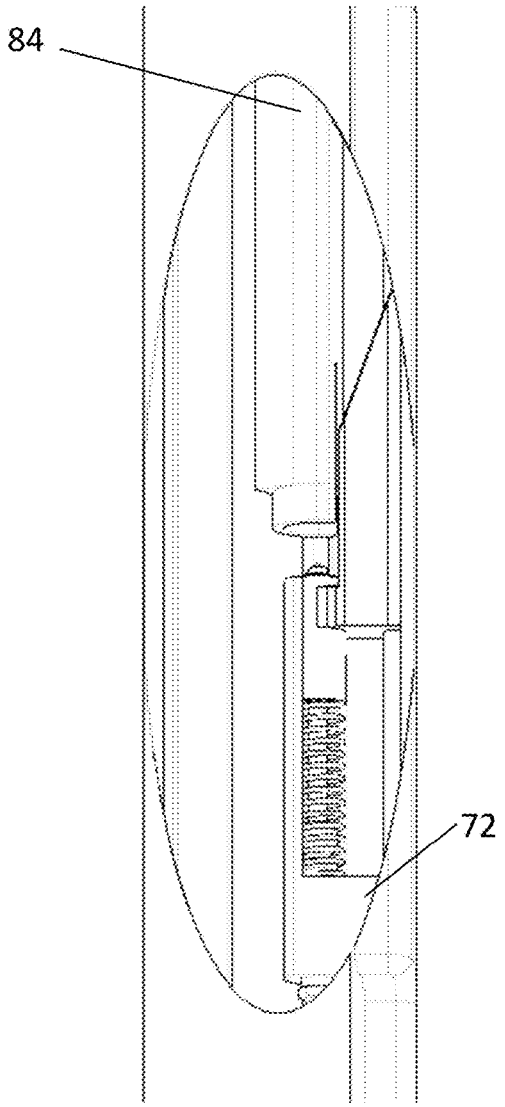
Figure 10B:
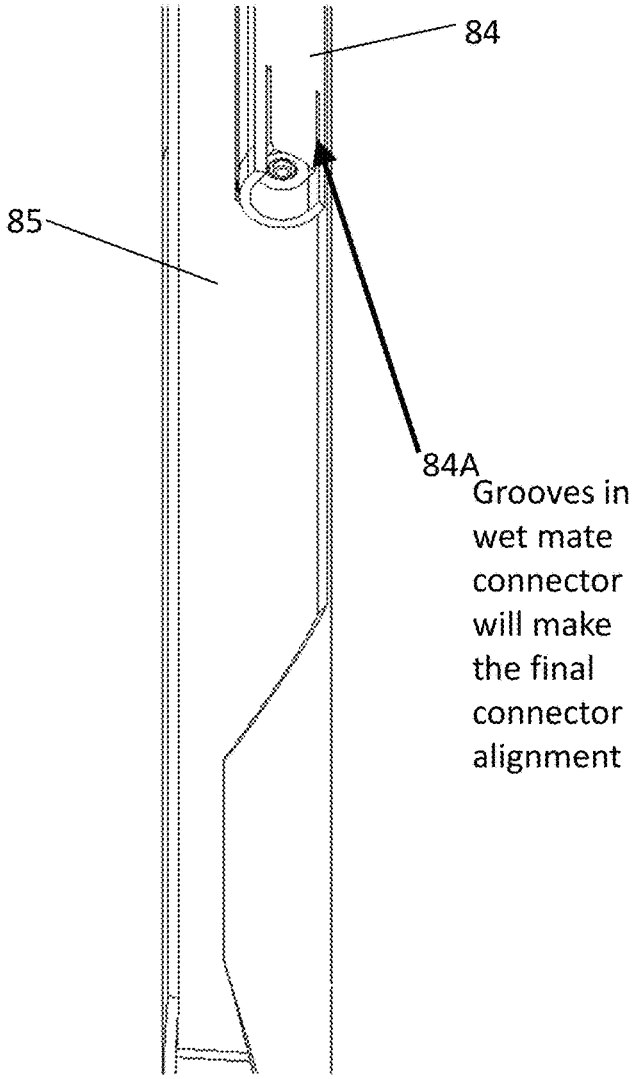

FIG. 10 A is a sketch of a wet mate male and female alignment prior to mating and FIG. 10 B is a sketch of a Bottom view of female wet mate connector.

Figure 11A:
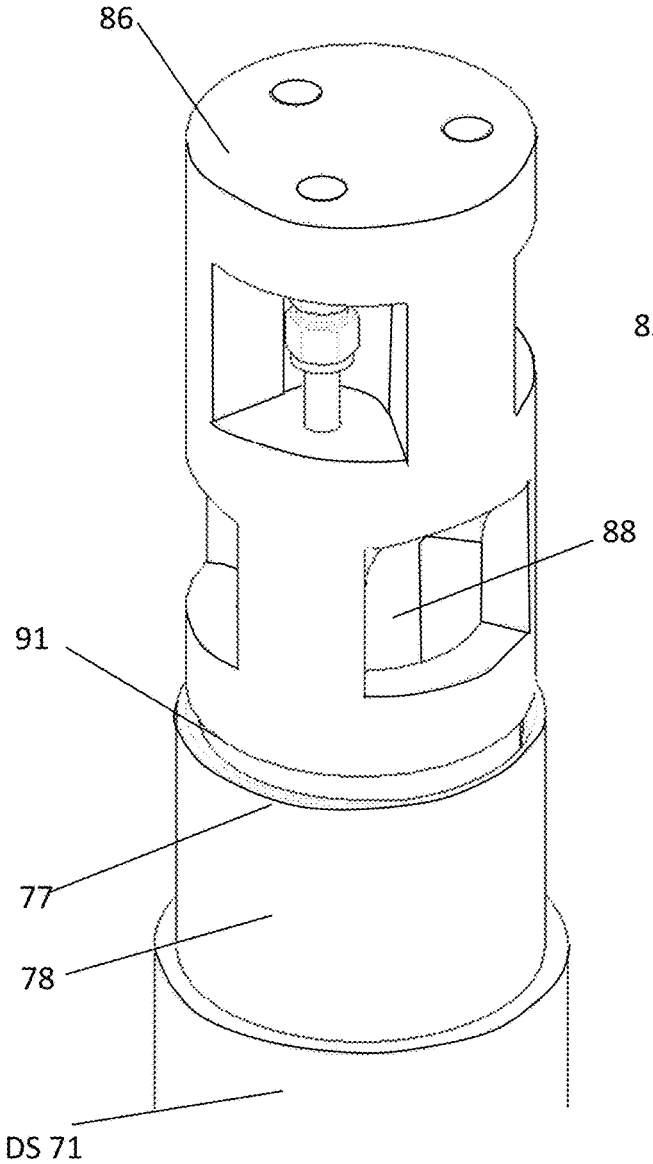
Figure 11B:
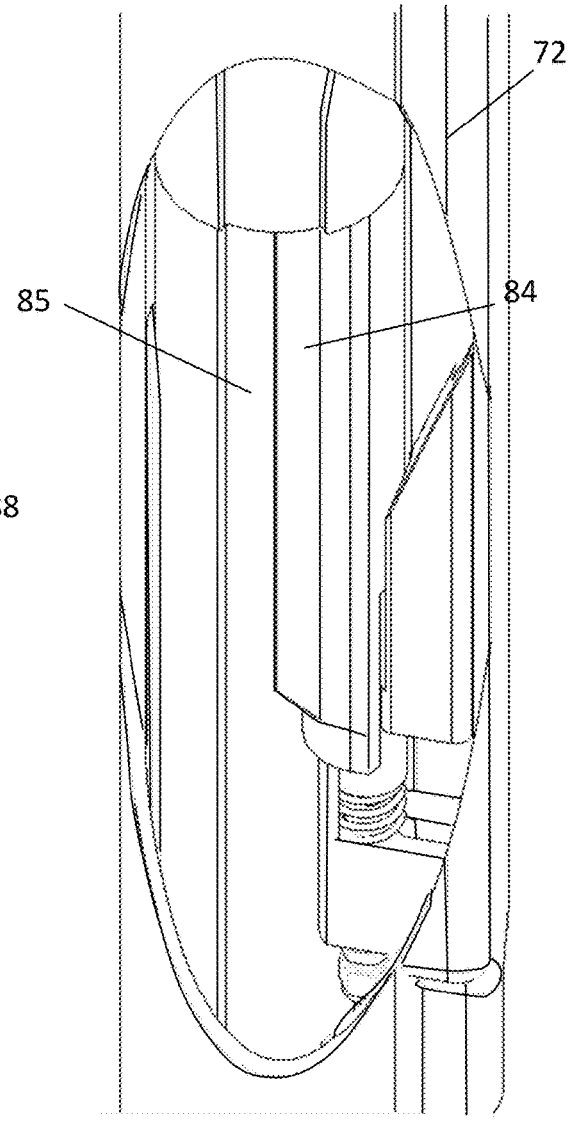
Figure 12A:
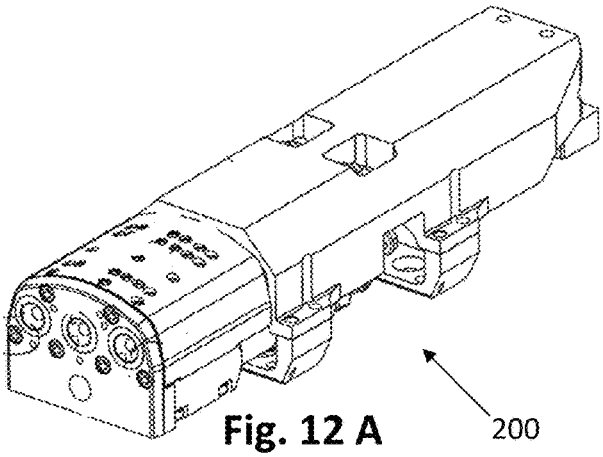
Fig. 12 A Prior Art
Figure 12B:
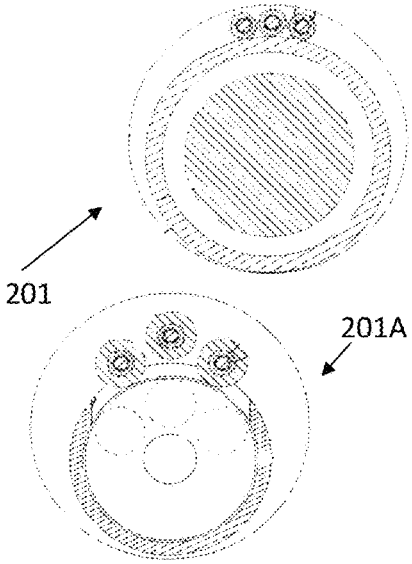
Fig. 12 B Prior Art
Figure 12C:
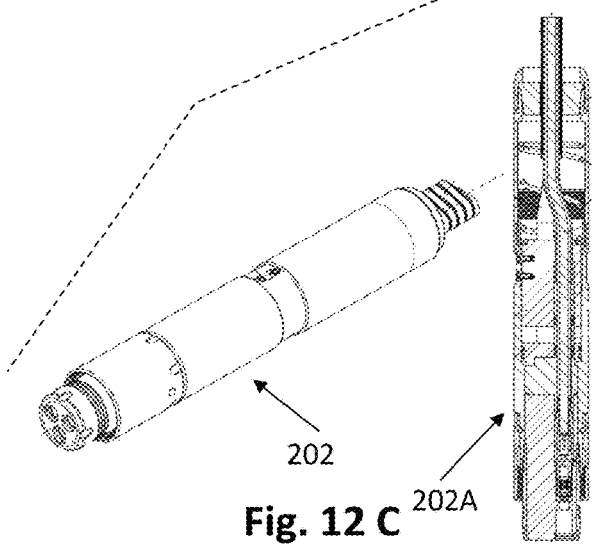
Fig. 12 C Prior Art
Figure 12D:
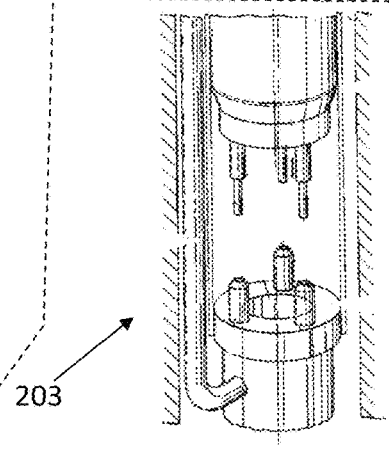
Fig. 12 D Prior Art

FIG. 11 A is a sketch of a landing shoulder on motor connector approaching landing shoulder in docking station and FIG. 11 B is a sketch of a final mate of wet mate connectors with shuttle body moving down to allow shuttle pin to insert in female connector.

FIGS. 12 A through 12 I are sketches and descriptions of prior art.

DESCRIPTION OF THE DRAWINGS—REFERENCE NUMERALS

The following list refers to the drawings:

TABLE B

| Reference numbers - | |
|---|---|
| Ref # | Description |
| 30 | Electric Submersible Pump (ESP) Rig Less Deployment Method and System 30 for Oil Wells and the like |
| 70 | docking station string 70 |
| 71 | docking station tube 71 |
| 72 | male, inline wet mate connector housing 72 and pocket |
| 75 | aligning tab 75 for rotational movement of motor connection 80 in guide groove 83 on alignment guide 78 |
| 77 | landing shoulder 77 on alignment guide 78 |
| 78 | alignment guide 78 is a tube that is positioned at the top of the docking station 70 and sits inside the docking station tube 71 |
| 79 | alignment groove 79 on the alignment guide 78 |
| 80 | Motor connector string 80 |
| 81 | electric submersible motor (ESP) 81 |
| 82 | Rotational alignment spear (bishop's hat) 82 |
| 83 | rotation guide groove 83 |
| 84 | female, inline wet mate connectors 84 on motor connector 80 |
| 84A | Grooves 84A in wet mate connector 84 |
| 85 | partition plate 85 |
| 86 | motor connector 86 |
| 87 | landing shoulder 87 on motor connector string 80 |
| 88 | discharge port 88 |
| 89 | flow tube 89 |
| 90 | vertical alignment tab 90 |
| 93 | Alignment groove 93 on motor connector 80 for male wet mate 72 on docking station 70 |
| 94 | Shuttle body 94 |
| 95 | alignment guide tube 95 with alignment tab 90 and orientation features |
| 97 | power cable 97 |
| 98 | production tubing 98 |
| 99 | product flow 99 |
| 100 | casing 100, CS |
| 200 | Prior Art 200 U.S. Pat. No. 9,028,264 - Downhole Electrical Connector - 2015 - Head |
| 201 | Prior Art 201 - U.S. Pat. No. 8,746,354 - Wet Connection System for Downhole Equipment - 2014 - Head |
| 202 | Prior Art 202 - U.S. Pat. No. 10,276,969 Connector w/ Sealing Boot & Moveable Shuttle 2019 - Campbell |
| 203 | Prior Art 203 - U.S. Pat. No. 7,533,461 - Method for Interconnecting Conduits in a Borehole - 20009 - Griffiths |
| 204 | Prior Art 204 - U.S. Pat. No. 9,270,051 - Wetmate Connector - 2016 - Christianson et al |
| 205 | Prior Art 205 - U.S. Pat. No. 9,546,527 - Wet Connection System for Downhole Equipment - 2017 - Head |
| 206 | Prior Art 206 - U.S. Pat. No. 9,556,686 - Wet-Mateable Connector Unit w/Gas Pressure Relief - 2017 - Krumpe |
| 207 | Prior Art 207 - U.S. Pat. No. 8,485,837 - Electrical Wet Connector in Downhole Environment 2013 - Head |
| 208 | Prior Art 208 - U.S. Pat. No. 11,021,939 - System and method related to pumping fluid in a borehole 2021 - Crowley, et al |

DETAILED DESCRIPTION OF PREFERRED EMBODIMENT

The present development is an Electric Submersible Pump (ESP) Rig Less Deployment Method and System for Oil Wells and the like. This invention relates to a method for making an electrical connection in an underground borehole that provides for the transmission of electric power from a power supply to the motor of an electric submersible pump (ESP). This invention relates to wet connectors for downhole use, which is to say, releasable connectors for electrical conductors which can be made and unmade in the fluid environment of a wellbore, particularly but not exclusively a hydrocarbon well. The field of the invention relates generally to wet mate connectors installed in downhole environments, and more particularly to a receptacle connector effectively engaged with a mating plug connector. This invention relates to wet connection systems for connecting a conductor or conductors to equipment deployed in a borehole, for example, an oil or gas well. Wet connection systems provide a connection that can be made and unmade in-situ in a liquid environment so that the deployed equipment can be disconnected and recovered without removing the conductor from the borehole, and then re-connected to the conductor in situ when the equipment is re-deployed. This invention relates to method and systems for electrical connections for conductors in a downhole environment, particular connections that are engageable and releasable downhole.

The advantages for the Electric Submersible Pump (ESP) Rig Less Deployment Method and System 30 for Oil Wells and the like are listed above in the introduction. Succinctly the benefits are that the system has/is:

A. Large through bore
B. Improved debris tolerance
C. No protective sleeve required for intervention
D. Capable of reverse circulation for pump assist retrieval and installation
E. Can have a more than 3 connectors to power multiple down hole components and systems
F. No special kick out tool required for installation
G. Small diameter motor connector and low-profile docking station allows for installation of standard 456 ESP motors in 7" tubing.
H. The smaller OD motor connector allowing for a shallow set sub-surface safety valve.

The preferred embodiment of an Electric Submersible Pump (ESP) Rig Less Deployment System for an Oil Well production downhole installation made of durable materials and comprised of a docking station that is semi-permanently and removably installed into a borehole of an oil well; a motor connector that may be removed from the borehole; an inline electrical connection between each of three motor connector and docking station comprising a power cable and three separate connectors to provide electrical power to a three-phase motor of an electric submersible pump (ESP); an option of an additional set of connectors can be incorporated in the system to facilitate electrical connections for other components; the docking station further comprises a main body, three electrical male connectors, and an alignment guide tube with orientation features and with a landing shoulder; and the motor connector further comprises three electrical female connectors, a partition mounting plate, and an alignment guide section with orientation features whereas the Electric Submersible Pump (ESP) Rig Less Deployment System for an oil well production installation lowers the initial cost for the operator, provides a simpler system that is more reliable, offers a larger through bore, and provides the ability for pump assisted installation and retrieval techniques for future developments.

There is shown in FIGS. 1-12 a complete description and operative embodiment of the Electric Submersible Pump (ESP) Rig Less Deployment Method and System 30 for Oil Wells and the like. In the drawings and illustrations, one notes well that the FIGS. 1-12 demonstrate the general configuration and use of this system. The various example uses are in the operation and use section, below.

The accompanying drawings, which are incorporated in and constitute a part of this specification, illustrate an embodiment of the Electric Submersible Pump (ESP) Rig Less Deployment Method and System 30 for Oil Wells and the like that is preferred. The drawings together with the summary description given above and a detailed description given below explain the principles of the system 30. It is understood, however, that the stated and described system 30 is not limited to only the precise arrangements and instrumentalities shown. Other examples of an ESP methods, systems, and uses are still understood by one skilled in the art of oil and gas well devices and systems to be within the scope and spirit shown here.

This method and system comprises a docking station that contains wet mate able connectors and a corresponding motor connector containing wet mate able connectors. The docking station is mated to the bottom of a production tubing string and lowered into the borehole in the same method as a standard installation. In this case, the production tubing string has an internal diameter that is larger than the outside diameter of the ESP. The power cable is banded to the outside of the production tubing string. The motor connector is mated to the ESP motor.

FIGS. 1 A and 1 B depict three-dimensional schematics of the two main components of a rig less ESP deployment method and system. The rig less deployment system shown here is comprised of a docking station 70 with wet mate able connectors, a power cable 97, and a motor connector string 80 that will be mated to an electric submersible pump (ESP). The docking station comprises a main body, wet mate able connectors and a power cable that is electrically connected to the wet mate able connectors and to a power source on the surface. The docking station will be hung at the bottom of a string of production tubing. The docking station will remain in the well for the life of the system. The motor connector will be mated to the bottom of an ESP and lowered into the well by wireline, coiled tubing, sucker rods or other suitable deployment method. FIG. 1 A is a sketch of an ESP/motor connector string and FIG. 1 B is a sketch of a docking station on production tubing string. Shown here are: an Electric Submersible Pump (ESP) Rig Less Deployment Method and System 30 for Oil Wells and the like; a docking station string 70; a motor connector string 80; an electric submersible motor (ESP) 81; a motor connector 86; a vertical alignment tab 90; a power cable 97; and a production tubing 98.

FIG. 2 A is a sketch of a wet mate connector 84 positions on motor connector 80, a power cable 97, a guide tube 95, and a production tubing 98 and FIG. 2 B is a sketch of a wet mate connector positions 72 on docking station connector 70. Demonstrated here are: a docking station string 70; a docking station tube 71; a male, inline wet mate connector housing 72 and pocket; a motor connector string 80; a rotational alignment spear (bishop's hat) 82; a rotation guide groove 83; a female, inline wet mate connectors 84 on motor connector 80; a partition plate 85; a motor connector 86; a flow tube 89; a power cable 97; and a production tubing 98.

FIGS. 3 A through 3 C and FIGS. 4 A through 4 C show the motor connector 80 and its features. The motor connector 80 comprises a flow tube 89 with orientation features, wet mate connectors 84 arranged on an axis parallel to the axis of the flow tube, conductor conduits, an alignment guide tube, a discharge 88, and landing shoulder tube 87, and an electrical connection head 86. The flow tube comprises a truncated tube with a flat plate 85 that is welded to the outer edge of the truncated tube. The flat plate provides mounting holes for the wet mate connectors 84. The bottom of the flow tube is shaped to a helical point 82 called an alignment spear or bishops hat (inverted). The helical point facilitates the initial alignment by contacting the matching abutment of the alignment guide 75 of the docking station 70. Opposite the connector mounting plate 85 is an alignment tab 90 on the outside diameter of the flow tube 89. The vertically aligned tab runs along the length of the flow tube and stops near to each end of the flow tube. The alignment tab will travel inside the alignment groove 79 of the alignment guide 78 in the docking station 78 to maintain the orientation of the motor connector 80 wet mate connectors 84 that are radially offset from the male wet mate connectors 72 in the docking station 70. The tab 90 and groove 79 will maintain this orientation until the wet mate connectors 84 of the motor connector 80 reach their corresponding connectors 72 of the docking station 70. The female wet mate connectors 84 are mounted to the flat mounting plate 85 of the flow tube 89 and fixed to the plate with fasteners. The wet mate connectors 84 are positioned such that they form a line that is parallel to the axis of the flow tube 89. The alignment guide tab 90 is affixed (welded) to the top of the flow tube 89.

The alignment guide tube 95 has a specific orientation with respect to the wet mate connectors 84. The alignment guide 95 is a tubular construction with an open inside diameter for fluid flow 99 and a groove 83 on the outside diameter for alignment.

The alignment groove 83 will interact with the abutment tab 75 on the inside of the alignment guide 78 of the docking station for final orientation of the connectors to facilitate the inline connection of the wet mate connectors. After the rotation, the groove 83 provides the path for the vertical drop to the final position for the female wet mate connectors 84 into the male connectors 72. The discharge tube 88 with landing shoulder 87 (on motor connector string 80) is affixed (welded) to the top of the alignment guide tube 95. The discharge tube has an open inside diameter from the bottom of the tube to the top of the discharge ports 88. The three discharge ports 88 are spaced around the circumference of the tube and allow fluid flow to pass from the inside of the tube to the outside. Above the discharge ports the tube is solid with three small diameter holes for the electrical conductor to pass. The electrical connection head is affixed to the top of the discharge tube. The head may be affixed to the discharge tube by either welding or threaded connection. The configuration of the connection head will be suitable to match the configuration of the motor 81 or sensor of the ESP to which it will be attached. The head will include terminals that are connected to the electrical conductor from the respective wet mate connectors. The head will be filled with dielectric oil during operation. The conductor conduits comprise a metal tube that contains the electrical conductor and dielectric oil. The three metal conduits will be affixed to the respective wet mate connectors at one end and to the discharge tube at the other end. The tubing will be affixed with a tubing fastener (Swagelok or equivalent). One also sees that in one embodiment of this invention the dielectric fluid from the ESP will be in direct contact with the dielectric fluid in the conductor conduit. In an alternate embodiment of this invention, the conductor conduit will be open to the borehole fluid. The electrical conductor will be sealed at the entry to the head. The conductor conduit will be filled with a heavy dielectric fluid that is in contact with the dielectric fluid in the wet mate connector. The heavy dielectric fluid will form the barrier between the borehole fluid and the electrical connection in the wet mate connector.

FIG. 3 A is a sketch of an ESP/Motor connector alignment features, FIG. 3 B is a sketch of a vertical alignment tab, and FIG. 3 C is a sketch ninety degrees from FIG. 3 A to show the position of the alignment tab on the outside of the flow tube. Components and features shown here include: a rotational alignment spear (bishop's hat) 82; a rotation guide groove 83; a female, inline wet mate connectors 84 on motor connector 80; a partition plate 85; a motor connector 86; a flow tube 89; a vertical alignment tab 90; and alignment guide tube 95 with alignment and orientation features.

FIG. 4 A is a sketch of the position of a discharge head and the wet mate connector on the motor connector, FIG. 4 B is a sketch of a discharge head and landing shoulder on motor connector, and FIG. 4 C is a sketch of a wet mate female connector. Features demonstrated in these sketches are: a rotational alignment spear (bishop's hat) 82; a female, inline wet mate connectors 84 on motor connector 80; a partition plate 85; a motor connector 86; a landing shoulder 87; a discharge port 88; a flow tube 89; and a vertical alignment tab 90.

FIG. 5 A is a sketch of a fluid flow path through motor connector, FIG. 5 B is a sketch of the Section A-A bottom view fluid flow path, and FIG. 5 C is a sketch of Section B-B showing a top view of the fluid flow path. Shown in these sketches are: a male, inline wet mate connector housing 72 and pocket; a motor connector string 80; a rotation guide groove 83; a female, inline wet mate connectors 84 on motor connector 80; a partition plate 85; a flow tube 89; a vertical alignment tab 90; alignment guide tube 95 with alignment and orientation features; and a product flow 99. One sees as the motor connector 80 (MC) is inserted into the docking station 70 (DS) the bottom two wet mate connectors 84 of the MC 80 must pass by the top 2 wet mate connectors 72 of the DS 70. That is the purpose of the first orientation feature with the bishop's hat 82 of the MC 80 and the alignment tab 75 of the DS 70. Section view B-B shows the docking station for reference. The MC position is the mirror of what is shown in section A-A. The section view B-B shows the position of the MC as the connectors are passing by each other. That is the purpose of the open space on the MC. The one of three noted is the MC wet mate connector.

FIG. 6 A is a sketch of the alignment guide of a docking station with the alignment features and landing shoulder, FIG. 6 B is a sketch of a top view, and FIG. 6 C is a sketch of an alignment guide features. Portrayed here are: a docking station tube 71; a male, inline wet mate connector housing 72 and pocket; an aligning tab 75 for rotational movement of motor connection 80 in guide groove 83 on alignment guide 78; a landing shoulder 77 on alignment guide 78; an alignment guide 78 is a tube that is positioned at the top of the docking station 70 and sits inside the docking station tube 71; an alignment groove 79 on the alignment guide 78; and a shuttle body 94.

Further shown in FIGS. 6 A through 6 C shows the docking station 70 comprises a main body 71, three electrical connectors 72, and an orientation alignment guide tube 78 with features and with a landing shoulder 77. The docking station 70 is connected to a production tubing string 98 that is installed in the borehole. The production tubing string hangs in the borehole from a tubing hanger that is landed inside the well head. The production tubing string forms the conduit/piping that will carry fluid from the reservoir through the ESP 81 and to the surface. The docking station 70 is in the tubing string at the ESP pump setting depth. The electrical power is delivered from a power source on the surface. The power is delivered to the docking station through a power cable 97 that is banded to the outside of the tubing string 98. The power cable is connected to the electrical connectors through a pressure sealed mechanical connector (Swagelok or equivalent) at the docking station.

FIG. 7 is a sketch of a wet mate connector position in the main body. It shows: a docking station tube 71; a male, inline wet mate connector housing 72 and pocket; and a shuttle body 94. One notes that the main body of the docking station 70 comprises a tube with threaded connections at each end and three pockets that provide the housing for the electrical connectors 72. The pockets are affixed at the circumference to the tubing (welded or press fit) with the pocket protruding from the outside diameter. There is a supporting ledge that protrudes inward and supports the body of the connector and provides a connection for the conductor conduit of the connector. There is a through hole at the top of the pocket for the conductor conduit to power cable mating. The pockets 72 are in alignment and the axis of alignment is parallel to the axis of the tubing 71 such that if the tubing is in a vertical orientation the connector pocket(s) is/are directly above one another. The orientation tab/guide 75 is affixed to the alignment guide 78 above the pockets for the electrical connectors. The alignment guide 78 is a tubular construction that is positioned inside the main body of the tubing such that the outside diameter (OD) of the guide 78 is contact with the inside diameter (ID) of the main body and is affixed to the body by press fit or weld. The guide 78 has a specific orientation with respect to the connector pockets 72. The orientation/alignment guide 78 includes a diamond shaped abutment 75 that protrudes inward from the guide and a groove that is in alignment with the axis of the docking station. These features interact with features on the motor connector 80 to orient the connectors 72,84 for an inline connection. The landing shoulder 77 on the guide 78 will interact with the landing shoulder 87 of the motor connector string 80 and provide a support for the weight of the ESP and the downward force generated by the lifting force of the fluid flow 99.

FIG. 8 A is a sketch of a motor connector rotation spear function, FIG. 8 B is a sketch of a motor connector rotated to begin straight drop, and FIG. 8 C is a sketch of a motor connector alignment tab as it enters the alignment groove and drops straight into the docking station. Here one sees demonstrated the following: a docking station tube 71; a male, inline wet mate connector housing 72 and pocket; an aligning tab 75 for rotational movement of motor connector 80 in guide groove 83 on alignment guide 78; a landing shoulder 77 on alignment guide 78; an alignment guide 78 is a tube that is positioned at the top of the docking station 70 and sits inside the docking station tube 71; an alignment groove 79 on the alignment guide 78; a motor connector string 80; a rotational alignment spear (bishop's hat) 82; a female, inline wet mate connectors 84 on motor connector 80; a partition plate 85; a flow tube 89; and a vertical alignment tab 90.

FIG. 9 A is a sketch of an alignment tab in docking station contacting the final alignment groove in the motor connector alignment guide and FIG. 9 B is a sketch of a motor connector rotated to final position to begin final drop and mate. Provided in these two sketches are drawings of: a male, inline wet mate connector housing 72 and pocket; an aligning tab 75 for rotational movement of motor connection 80; a rotation guide groove 83; and a female, inline wet mate connectors 84 on motor connector 80.

FIG. 10 A is a sketch of a wet mate male and female alignment prior to mating and FIG. 10 B is a sketch of a Bottom view of female wet mate connector. These show: a male, inline wet mate connector housing 72 and pocket; a female, inline wet mate connectors 84 on motor connector 80; a set of grooves 84A in wet mate connector 84; and a partition plate 85.

FIG. 11 A is a sketch of a landing shoulder on motor connector approaching landing shoulder in docking station and FIG. 11 B is a sketch of a final mate of wet mate connectors with shuttle body moving down to allow shuttle pin to insert in female connector. Portrayed here are: a docking station tube 71; a male, inline wet mate connector housing 72 and pocket; a landing shoulder 77 on alignment guide 78; a female, inline wet mate connectors 84 on motor connector 80; a partition plate 85; a motor connector 86; and a discharge port 88; and a landing shoulder 87 on motor connector string 80.

FIGS. 12 A through 12 I are sketches of prior art. Here former patents and applications for oil well electrical connections and deployment schemes. These include: a prior art 200 U.S. Pat. No. 9,028,264—Downhole Electrical Connector—2015—Head; a prior art 201—U.S. Pat. No. 8,746,354—Wet Connection System For Downhole Equipment—2014—Head; a prior art 202—U.S. Pat. No. 10,276,969—Connector w/ Sealing Boot & Moveable Shuttle—2019—Campbell; a prior art 203—U.S. Pat. No. 7,533,461—Method for Interconnecting Conduits In a Borehole—20009—Griffiths; a prior art 204—U.S. Pat. No. 9,270,051—Wetmate Connector—2016—Christianson et al; a prior art 205—U.S. Pat. No. 9,546,527—Wet Connection System for Downhole Equipment—2017—Head; and Prior Art 208—U.S. Pat. No. 11,021,939—System and method related to pumping fluid in a borehole 2021—Crowley, et al. As can be seen, the Electric Submersible Pump (ESP) Rig Less Deployment Method and System 30 for Oil Wells and the like is a unique combination and use as described herein. For example, specific as to comparing the most recent U.S. Pat. No. 11,021,939, this application by Wetzel differs from Crowley, et al. in the orientation of the wet mate connectors and many other specific and novel features. Advantages of Wetzel over Crowley, et al. include: 1. Larger through bore that is facilitated by two critical design features (a) vertical alignment of the wet mate connectors and (b) wet mate connectors that are housed partially within the production tubing inside diameter (ID) and partially in a pocket that is outside of the production tubing ID. 2. Smaller outside diameter (OD) of the motor connector allows for a smaller ID of the production tubing which facilitates the ability to install a "456" ESP inside a standard seven-inch (7") casing. That is not possible with the Crowley, et al. system. A person skilled in the art of oils wells and pumping systems understands that a "456" ESP is a standard model for all ESP companies and many of them are run inside a well with the standard seven-inch (7") casing. The ESP OD for a "456" is four and fifty-six hundredths of an inch (4.56"). For these installations the power cable and control lines are run on the outside of the production tubing that has a five and one-half inch (5.5") OD. The cable and control lines are clamped on the outside of the production tubing. The OD of the clamp exceeds the allowable inside diameter of the casing. To achieve the maximum through bore in the Crowley, et al./Schlumberrger system the motor connector is at the maximum allowable ID (4.892"). In the Wetzel configuration and orientation, the motor connector is equal to or smaller than the four and fifty-six hundredths of an inch (4.56") ESP motor diameter. That allows for making a pup joint with a smaller ID and OD where the power cable(s) on control lines is(are) attached. 3. The vertical alignment orientation allows for the addition of wet mate connectors to drive other electrical components that may be incorporated in the well completion.

The anticipated durable materials for the Electric Submersible Pump (ESP) Rig Less Deployment Method and System 30 for Oil Wells include: a 316, 410 or 420 stainless steels; high temperature (greater than 200 degrees Celsius) elastomeric such as FFKM and FKM (fluorocarbon rubber polymers, Fluro-Elastomer) and TFE/P (a copolymer of tetrafluoroethylene and propylene with a fluorine content of approximately 54%); insulators of 450 polyether ketone polymer (PEK); ceramic insulator materials and composite materials.

The details mentioned here are exemplary and not limiting. Other specific components and manners specific to describing an Electric Submersible Pump (ESP) Rig Less Deployment Method and System 30 for Oil Wells and the like may be added as a person having ordinary skill in the field of oil well systems, pump, and accessories in the oil well and oil production industry and their uses well appreciates.

OPERATION OF THE PREFERRED EMBODIMENT

The Electric Submersible Pump (ESP) Rig Less Deployment Method and System 30 for Oil Wells and the like has been described in the above embodiment. The manner of how the device operates is described below. One notes well that the description above and the operation described here must be taken together to fully illustrate the concept of the method and system. The preferred embodiment of an Electric Submersible Pump (ESP) Rig Less Deployment System for an Oil Well production installation comprised of a docking station that is semi-permanently and removably installed into a borehole of an oil well; a motor connector that may be removed from the borehole; an electrical connection between each of the three motor connector and docking station comprising a power cable and three separate connectors to provide electrical power to a three-phase motor of an electric submersible pump (ESP); an option of an additional set of connectors can be incorporated in the system to facilitate electrical connections for other components; the docking station further comprises a main body, three electrical male connectors, and an alignment guide tube with orientation features and with a landing shoulder; and the motor connector further comprises three electrical female connectors, a partition mounting plate, and an alignment guide section with orientation features whereas the Electric Submersible Pump (ESP) Rig Less Deployment System for an oil well production installation lowers the initial cost for the operator, provides a simpler system that is more reliable, offers a larger through bore, and provides the ability for pump assisted installation and retrieval techniques for future developments.

In operation the docking station is installed in the borehole on a string of production tubing. The motor connector is mounted to the bottom of the ESP string. The ESP assembly may be lowered into the borehole through the production tubing using a suitable deployment method such as wireline, coiled tubing, or sucker rods. The features of the motor connector and docking station facilitate the orientation of the wet mate connectors to make an inline electrical connection of the set of three connectors. The electrical connectors in both the docking station and the set of three motor connector are aligned in an axis that is parallel to the axis of the production tubing string. The orientation of the connectors requires three distinct motions. a. first rotating the set of three inline wet mate connectors to be in a position that allows the wet mate connectors of the motor connector to pass by the set of three inline wet mate connectors of the docking station; b. second the motor connectors then travelling downward along the axis of the tubing in a straight path until each of the set of three inline the wet mate connectors of the motor connector reach each of the set of three inline corresponding wet mate connectors in the docking station; c. third rotating and aligning the set of three inline wet mate connectors of the motor connector and then travelling in a straight path downward and mate and secure with the set of three inline connectors in the docking station; and d. for removal of the ESP, reversing steps a, b and c.

Further as to the operation, the ESP/motor connector assembly is lowered into the well by one of the methods stated above. The system typically can orient the wet mate able connectors such that an inline connection is performed. The running tool string is then released from the ESP and pulled to the surface. The ESP may now be powered on. Although these systems have promised significant savings in operating costs the uptake in the market has been slow. The complexity of the current systems in addition to the ancillary tools and equipment required for well control during the ESP retrieval create a significant initial cost for system installation. The return on investment is not realized until the ESP is retrieved and reinstalled. In addition, the complexity and limited track record on these systems casts some doubt on the reliability of the system and subsequently the ability of the well operator to realize the proposed savings. During the life of a well it is often required to pull the ESP to perform some type of work below the docking station. This work may include opening and closing of valves, repairing a damaged safety valve, perforating a new production zone or some other well remediation process. These operations require running tools through the docking station to perform this work. The size of the through bore is critical to the ability to perform the desired work.

With this description it is to be understood that the Electric Submersible Pump (ESP) Rig Less Deployment Method and System for Oil Wells and the is not to be limited to only the disclosed embodiment of product. The features of the method and system 30 are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. Various features and aspects of the disclosed embodiments can be combined with or substituted for one another to form varying modes of the disclosed inventions.

Thus, it is intended that the scope of at least some of the present inventions herein disclosed should not be limited by the disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any embodiment, feature, or combination of features shown herein. This is true even if only a single embodiment of the feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed considering the number of recited significant digits and by applying ordinary rounding techniques.

The present invention contemplates modifications as would occur to those skilled in the art. While the disclosure has been illustrated and described in detail in the figures and the foregoing description, the same is to be considered as illustrative and not restrictive in character, it being understood that only selected embodiments have been shown and described and that all changes, modifications, and equivalents that come within the spirit of the disclosures described heretofore and or/defined by the following claims are desired to be protected.

What is claimed is:

1. An Electric Submersible Pump (ESP) Rig Less Deployment System for an Oil Well production downhole installation made of durable materials and comprised of a. a docking station that is semi-permanently and removably installed into a borehole of an oil well;

b. a motor connector that is removable from the borehole; and c. an inline electrical connection between each of the three motor connectors and the docking station comprising a power cable and three separate inline connectors that each provide one phase of electrical power to a three-phase motor for an ESP;

whereas each of the three electrical connections are positioned on the docking station and motor connector are aligned with an axis of the tubing string such that when placed in a vertical well the connectors are positioned one above the other and the ESP Rig Less Deployment System for an Oil Well production installation lowers the initial cost for an operator, provides a simpler system that is more reliable, offers a larger through bore compared to an ESP using horizontally arranged electrical connections, and provides the ability for pump assisted installation and retrieval techniques for future developments.

2. The ESP Rig Less Deployment System for an Oil Well production downhole installation in claim 1 wherein the durable materials are selected from the group consisting of 316 stainless steel, 410 stainless steel, 420 stainless steel, greater than 200 degrees Celsius capable elastomeric fluorocarbon rubber polymer, greater than 200 degrees Celsius capable elastomeric fluro-elastomer, 450 polyether ketone polymer, and a copolymer of tetrafluoroethylene and propylene with a fluorine content of approximately 54.

3. The ESP Rig Less Deployment System for an Oil Well production downhole installation in claim 1 wherein the docking station further comprises a main body, three inline electrical male connectors, and an alignment guide tube with a set of orientation features and with a landing shoulder.

4. The ESP Rig Less Deployment System for an Oil Well production downhole installation in claim 3 wherein the set of orientation features for the docking station alignment guide tube comprise an alignment guide, an alignment groove, and an alignment tab.

5. The ESP Rig Less Deployment System for an Oil Well production downhole installation in claim 3 wherein the set of orientation features for the motor connector alignment guide tube comprise a rotational guide groove, a rotational alignment spear, and a groove on each of the three inline electrical female connectors.

6. The ESP Rig Less Deployment System for an Oil Well production downhole installation in claim 1 wherein the motor connector further comprises three electrical female connectors, a partition mounting plate, and an alignment guide section with a set of orientation features.

7. The ESP Rig Less Deployment System for an Oil Well production downhole installation in claim 6 wherein the set of orientation features for each of the inline motor connectors alignment guide tube comprise a rotational guide groove, a rotational alignment spear, and a groove on each of the three electrical female connectors.

8. The ESP Rigless Deployment for an oil well production downhole installation in claim 1 wherein the connectors in the docking station are comprised of a circular body containing the conductor pin and wiper seals and a wedge shaped abutment containing the pressure balance system and whereas the circular body is within the inside diameter of the docking station and the abutment is positioned in a pocket with its outside diameter in contact with the inside diameter of the pocket of the docking station.

9. The ESP Rigless Deployment for an oil well production downhole installation in claim 1 wherein after a rotation of the retrievable ESP and motor connector about the main axis of the docking station align the male and female connectors the connectors are mated by moving the ESP and motor connector along the axis of the docking station.

10. The ESP Rigless Deployment for an oil well production downhole installation in claim 1 wherein the docking station maintains a pressure sealed barrier between the production internal fluid and the external fluid allowing the power cable that is on the outside of the docking station to not be subjected to the corrosive effects of well bore fluid and pressure variations.

11. An ESP Rig Less Deployment System for an Oil Well production downhole installation made of durable materials and comprised of a. a docking station that is semi-permanently installed into a borehole of an oil well and that further comprises a main body, three inline electrical male connectors, and an alignment guide tube with a set of orientation features and with a landing shoulder;

b. a set of three motor connectors that is removable from the borehole and that further comprises three inline electrical female connectors, a partition mounting plate, and an alignment guide section with a set of orientation features; and c. an inline electrical connection between each of the motor connectors of the set of three motor connectors and the docking station comprising a power cable and three separate inline connectors that each provide one phase of electrical power to a three-phase motor for an ESP whereas each of the three electrical connections are positioned on the docking station and motor connector are aligned with an axis of the tubing string such that when placed in a vertical well the connectors are positioned one above the other and the ESP Rig Less Deployment System for an Oil Well production installation lowers the initial cost for an operator, provides a simpler system that is more reliable, offers a larger through bore compared to an ESP using horizontally arranged electrical connections, and provides the ability for pump assisted installation and retrieval techniques for future developments.

12. The ESP Rig Less Deployment System for an Oil Well production downhole installation in claim 11 wherein the durable materials are selected from the group consisting of 316 stainless steel, 410 stainless steel, 420 stainless steel, greater than 200 degrees Celsius capable elastomeric fluorocarbon rubber polymer, greater than 200 degrees Celsius capable elastomeric fluro-elastomer, and 450 polyether ketone polymer.

13. The ESP Rig Less Deployment System for an Oil Well production downhole installation in claim 11 wherein the set of orientation features of the docking station alignment guide tube comprise an alignment guide, an alignment groove, and an alignment tab.

14. A method for operating the ESP Rig Less Deployment System for an Oil Well production comprising: installing a docking station in a borehole on an ESP string of a production tubing; mounting a motor connector to the bottom of the ESP string; lowering an assembly of the docking station, ESP string and motor connector into the borehole through the production tubing using a suitable deployment device; facilitating an orientation of a set of three wet mate connectors positioned in a docking station parallel to an axis of the docking station and oriented such that in a vertical well the connectors are one above the other to make an inline electrical connection using the alignment guide features of the motor connector and docking station; completing the alignment of the set of three inline wet mate connectors in both the docking station and each of a set of three motor connectors by assuring them to be parallel to an axis of the production tubing string by three distinct motions:

a. first rotating the set of three inline wet mate connectors to be in a position that allows the wet mate connectors of the motor connector to pass by the set of three inline wet mate connectors of the docking station;

b. second the motor connectors then travelling downward along the axis of the tubing in a straight path until each of the set of three inline the wet mate connectors of the motor connector reach each of the set of three inline corresponding wet mate connectors in the docking station;

c. third rotating and aligning the set of three inline wet mate connectors of the motor connector and then travelling in a straight path downward and mate and secure with the set of three inline connectors in the docking station; and d. for removal of the ESP, reversing steps a, b, and c.

15. The method for operating the ESP Rig Less Deployment System for an Oil Well production in claim 13 wherein the suitable deployment device is selected from the group consisting of wireline, coiled tubing, and sucker rods.

16. The method for operating the ESP Rig Less Deployment System for an Oil Well production in claim 13 wherein the Rig Less Deployment System is made of a durable material.

17. The method for operating the ESP Rig Less Deployment System for an Oil Well production in claim 15 wherein the durable material is selected from the group consisting of 316 stainless steel, 410 stainless steel, 420 stainless steel, greater than 200 degrees Celsius capable elastomeric fluorocarbon rubber polymer, greater than 200 degrees Celsius capable elastomeric fluro-elastomer, and 450 polyether ketone polymer.

* * * * *